US010589404B2

(12) United States Patent
Wang

(10) Patent No.: US 10,589,404 B2
(45) Date of Patent: Mar. 17, 2020

(54) WRENCH

(71) Applicants: Hangzhou Great Star Tools Co., Ltd., Hangzhou (CN); Hangzhou Great Star Industrial Co., Ltd., Hangzhou (CN)

(72) Inventor: Min Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 77 days.

(21) Appl. No.: 15/565,205

(22) PCT Filed: May 5, 2015

(86) PCT No.: PCT/CN2015/078249
§ 371 (c)(1),
(2) Date: Oct. 9, 2017

(87) PCT Pub. No.: WO2016/176817
PCT Pub. Date: Nov. 10, 2016

(65) Prior Publication Data

US 2018/0079055 A1 Mar. 22, 2018

(51) Int. Cl.
*B25B 13/00* (2006.01)
*B25B 13/46* (2006.01)
(Continued)

(52) U.S. Cl.
CPC ..... *B25B 13/462* (2013.01); *B25B 13/46* (2013.01); *B25B 13/481* (2013.01); *B25B 23/0007* (2013.01)

(58) Field of Classification Search
USPC ..... 81/52, 59.1, 60, 61
See application file for complete search history.

(56) References Cited

U.S. PATENT DOCUMENTS 1,694,377 A 12/1928 Lavaud
5,086,673 A 2/1992 Korty
(Continued)

FOREIGN PATENT DOCUMENTS

CN 101135366 3/2008
CN 203495824 3/2014
(Continued)

OTHER PUBLICATIONS

International Search Report for International Patent Application No. PCT/CN2015/078249 dated Feb. 16, 2016.
(Continued)

*Primary Examiner* — Joseph J Hail
*Assistant Examiner* — Shantese L McDonald
(74) *Attorney, Agent, or Firm* — Andrus Intellectual PropertyLaw, LLP

(57) ABSTRACT

Disclosed is a wrench, which is used for wrenching a workpiece and comprises a unidirectional transmission mechanism. The unidirectional transmission mechanism comprises rollers, a first member and a second member at least partially sheathed in the first member. The first member is fixedly provided at a wrenching portion of the wrench, and the second member is used for mating with the workpiece. The directions of the rotating torque from the wrenching portion are a first direction and a second direction along the axis of rotation of the first member. With regard to one of the rotating torque of the first direction and the rotating torque of the second direction, the second member is stationary relative to the first member so as to output the rotating torque to the workpiece; and with regard to the other one thereof, the second member rotates relative to the first member without outputting the rotating torque to the workpiece. The torque of the unidirectional transmission mechanism can meet the demand of using a wrench, and at the same time,
(Continued)

the unidirectional transmission mechanism remains silent in use and has the characteristic of wear resistance of bearings.

8 Claims, 18 Drawing Sheets

(51) Int. Cl.
*B25B 13/48* (2006.01)
*B25B 23/00* (2006.01)

(56) References Cited

U.S. PATENT DOCUMENTS 5,509,332 A * 4/1996 Donaldson, Jr. ..... B25B 13/06 81/121.1
5,765,669 A 6/1998 Adams et al.
5,848,561 A * 12/1998 Hsieh ..... B25B 13/462 81/59.1
6,253,646 B1 * 7/2001 Chang ..... B25B 13/462 192/44
8,186,246 B2 * 5/2012 Niven ..... B25B 13/462 166/77.51
8,210,072 B2 * 7/2012 Suter ..... B25B 15/04 81/59.1
2006/0102442 A1 5/2006 Dein
2011/0155531 A1 6/2011 Nease, III
2011/0203420 A1 * 8/2011 Riestra ..... B25B 13/04 81/59.1
2012/0279363 A1 11/2012 Tsao
2016/0129562 A1 * 5/2016 Douglass ..... B25B 13/481 81/59.1

FOREIGN PATENT DOCUMENTS

CN 204108904 1/2015
CN 204800523 11/2015
EP 2 314 826 A1 4/2011
JP 44013038 5/1969
JP 3027814 8/1996
JP 2000504396 4/2000
JP 2006145017 6/2006
JP 2006515916 6/2006
JP 4324280 9/2009
TW 201 226 116 A 7/2012
TW 201226116 7/2012

OTHER PUBLICATIONS

Extended European Search Report for European Patent Application No. 15891069.5 dated Apr. 10, 2019.
Office Action for CN 2017-557453, dated Feb. 5, 2019.

* cited by examiner

WRENCH

This application is the U.S. national stage application of International Application PCT/CN2015/078249, filed May 5, 2015, which international application was published on Nov. 10, 2016, as International Publication WO 2016/176817 A1, published on Nov. 10, 2016 in the Chinese language.

FIELD OF THE INVENTION

The present invention relates to hand tools, in particular to a wrench.

DESCRIPTION OF THE PRIOR ART

Generally when a wrench is in use, the movement of the hand in the direction of rotation has certain limits, and is not ongoing in one direction. The axis of rotation of the handle is coaxial with the main axis, and when in use it is normally as follows: first, wrenching the handle with a hand in a desired direction (such as to tighten or loosen a screw), and then reverse the rotation of the hand, so as to reposition the tool for the next cycle. In the second part of the cycle, the reverse rotation of the hand can be letting go of the handle and then re-gripping the handle, or maintaining the main shaft stationary during the reverse rotation of the handle by providing a unidirectional arrangement such as a ratchet mechanism in the tool, or reinserting after detaching the tool from the screw. Among the above mentioned, the second manner is more convenient because it does not require the hand to detach from the handle or the tool to be detached from the screw. However, because of the design of the tooth structure of the ratchet mechanism per se, the ratchet mechanism is bound to cause clattering noise in the wrench in use, which is considered an unpleasant experience in use by many users.

Therefore, those skilled in the art are committed to the development of a wrench which realizes a silent unidirectional transmission on a workpiece.

SUMMARY OF THE INVENTION

In view of the above-described drawbacks of the prior art, the technical problem to be solved by the present invention is to provide a wrench which achieves a silent unidirectional transmission on a workpiece by providing a unidirectional transmission mechanism at the wrenching portion of the wrench.

To achieve the above object, the present invention provides a wrench for wrenching a workpiece, which includes a wrenching portion and a gripping portion, the gripping portion extending and being connected at its extending end to the wrenching portion, wherein the wrench further includes a unidirectional transmission mechanism including rollers, a first member and a second member at least partially sheathed in the first member; the first member is fixedly provided at the wrenching portion of the wrench, the second member is used for mating with the workpiece; the directions of the rotating torque from the wrenching portion are a first direction and a second direction along an axis of rotation of the first member; for one of the rotating torque of the first direction and the rotating torque of the second direction, the rollers cause the second member to be stationary relative to the first member so as to output the rotating torque to the workpiece; and for the other one of the rotating torque of the first direction and the rotating torque of the second direction, the rollers cause the second member to rotate relative to the first member without outputting the rotating torque to the workpiece.

Optionally, a first surface of the first member and a second surface of the second member are opposed to each other; the first surface is a smooth curved surface, the second surface has a plurality of grooves distributed in a direction perpendicular to the axis of rotation; each of the grooves together with the first surface it is opposed to defines a movement room for the roller; the roller driven by the first member moves from a first part of the movement room to a second part of the movement room or from the second part to the first part, the roller in the first part can rotate freely and the roller in the second part is sandwiched between the first member and the second member.

Optionally, a second surface of the first member and a first surface of the second member are opposed to each other; the first surface is a smooth curved surface, the second surface has a plurality of grooves distributed in a direction perpendicular to the axis of rotation; each of the grooves together with the first surface it is opposed to defines a movement room for the roller; the roller driven by the first member moves from a first part of the movement room to a second part of the movement room or from the second part to the first part, the roller in the first part can rotate freely and the roller in the second part is sandwiched between the first member and the second member.

Further, the first surface is a cylindrical surface.

Further, the roller is a ball roller, a pin roller or a needle roller.

Further, the wrench further includes an elastic member arranged in the first part, the elastic member extends in a direction from the first part to the second part and abuts the roller so that the roller is sandwiched between the first member and the second member.

Optionally, the grooves are evenly or unevenly distributed on a cross-section of the second surface perpendicular to the axis of rotation.

Optionally, the grooves are evenly or unevenly distributed on a part of a cross-section of the second surface perpendicular to the axis of rotation adjacent to the gripping portion; the number of the grooves is not less than 3.

Further, the second member has a third surface for mating with the workpiece.

Optionally, a second surface of the first member and a first surface of the second member are opposed to each other; the first surface and the second surface are both smooth curved surfaces; each of the rollers is distributed between the first surface and the second surface, any two adjacent rollers are connected by an elastic member therebetween, the extending direction of the elastic member is from one of the rolls to the other one of the rollers; a cross-section of the roller perpendicular to the axis of rotation has a maximum width and a minimum width, the maximum width is greater than the distance between the first surface and the second surface where the roller is located, the minimum width is less than the distance between the first surface and the second surface where the roller is located; in the rotation of the roller driven by the first member, the included angle between an axis in a direction of the maximum width of the cross-section thereof and the normal line of the first surface where the roller is located gradually increases or decreases.

Further, the first surface and the second surface are cylindrical surfaces.

Optionally, a first surface of the first member and a second surface of the second member are opposed to each other; the first surface is a smooth curved surface, the second surface has grooves at a part in proximity to the gripping portion, the groove together with the first surface it is opposed to defines a movement room for the respective rollers; any two adjacent rollers are connected by an elastic member therebetween, the extending direction of the elastic member is from one of the rolls to the other one of the rollers; a cross-section of the roller perpendicular to the axis of rotation has a maximum width and a minimum width, the maximum width is greater than the distance between the first surface and the second surface where the roller is located, the minimum width is less than the distance between the first surface and the second surface where the roller is located; in the rotation of the roller driven by the first member, the included angle between an axis in a direction of the maximum width of the cross-section thereof and the normal line of the first surface where the roller is located gradually increases or decreases.

Optionally, a second surface of the first member and a first surface of the second member are opposed to each other; the first surface is a smooth curved surface, the second surface has grooves in a part in proximity to the gripping portion, the groove together with the first surface it is opposed to defines a movement room for the respective rollers; any two adjacent rollers are connected by an elastic member therebetween, the extending direction of the elastic member is from one of the rolls to the other one of the rollers; a cross-section of the roller perpendicular to the axis of rotation has a maximum width and a minimum width, the maximum width is greater than the distance between the first surface and the second surface where the roller is located, the minimum width is less than the distance between the first surface and the second surface where the roller is located; in the rotation of the roller driven by the first member, the included angle between an axis in a direction of the maximum width of the cross-section thereof and the normal line of the first surface where the roller is located gradually increases or decreases.

Further, the first surface is a cylindrical surface.

Further, the elastic member is in a pressed state and causes the roller to be sandwiched between the first member and the second member.

Further, the second member has a third surface for mating with the workpiece.

The invention further disclosed a wrench for wrenching a workpiece, which includes a wrenching portion and a gripping portion, the gripping portion extending and being connected at its extending end to the wrenching portion, wherein the wrench further includes a unidirectional transmission mechanism including rollers, a first member and a holder at least partially sheathed in the first member; the first member is fixedly provided at the wrenching portion of the wrench, the holder is used for accommodating the rollers and receiving the workpiece; the directions of the rotating torque from the wrenching portion are a first direction and a second direction along an axis of rotation of the first member; for one of the rotating torque of the first direction and the rotating torque of the second direction, the roller causes the workpiece to be stationary relative to the first member so as to output the rotating torque to the workpiece; and for the other one of the rotating torque of the first direction and the rotating torque of the second direction, the roller causes the workpiece to rotate relative to the first member without outputting the rotating torque to the workpiece.

Further, a first surface of the first member facing the holder is a smooth curved surface, the holder is provided with a plurality of spaces spaced apart in a direction perpendicular to the axis of rotation, each of the rollers is respectively accommodated in each of the spaces; the space has a first opening facing the first surface and a second opening facing the workpiece, the roller comes into contact with the first surface through the first opening, thereby being able to be driven by the first member, the roller comes into contact with the workpiece through the second opening; the space defined by the first surface and the surface of the workpiece is a movement room for the roller therein, the roller driven by the first member is moved from a first part of the movement room to a second part of the movement room or from the second part to the first part, the roller in the first part can rotate freely and the roller in the second part is sandwiched between the first member and the workpiece.

Further, the wrench further includes an elastic member arranged in the first part, the elastic member extends in a direction from the first part to the second part and abuts the roller so that the roller is sandwiched between the first member and the workpiece.

Optionally, the roller is a ball roller, a pin roller or a needle roller, the width of the second opening is less than the diameter of the ball roller, the pin roller or the needle roller, so that the roller does not detach from the space.

Optionally, the roller is a pin roller or a needle roller, and at least one end of the pin roller or needle roller has a protrusion; the holder is further provided with a limit structure, which makes the roller do not detach from the space, and the limit structure is a sliding slot; and the protrusion is embedded into the sliding slot.

Further, the holder is further provided with an elastic ejector pin for abutting the workpiece.

Optionally, the roller is a pin roller or a needle roller, the diameter of a middle part of the pin roller or the needle roller is less than the diameters of an upper part and a lower part thereof; the holder is further provided with a limit structure which makes the roller do not detach from the space, and the limit structure is a partly U-shaped elastic sheet; the middle part of the pin roller or the needle roller is clipped into a U-shaped part of the elastic sheet, the upper part and the lower part of the pin roller or the needle roller are used for contacting with the first member and the workpiece.

Further, the wrench further includes a retaining ring abutting an end face of the holder to confine the movement of the holder in the direction of the axis of rotation.

Further, the wrench further includes a snap spring for abutting the retaining ring, the snap spring fits with an annular groove provided in the wrenching portion to prevent the retaining ring from detaching from the wrenching portion in the direction of the axis of rotation.

Further, the wrench is provided with two wrenching portions, the gripping portion is connected between the two wrenching portions.

In preferred embodiments of the present invention, various available structures of unidirectional transmission mechanism are provided for the wrench. Since the unidirectional transmission mechanism applied to the wrench does not require for high-speed rotation, the torque thereof can meet the requirement for the usage of the wrench, thereby the wrench of the present invention is comparable with the wrench of the prior art. Meanwhile, the unidirectional transmission mechanism is silent in use, and has the characteristic of wear resistance of bearings.

The concepts, the specific structures and the technical effects of the present invention are described further below in conjunction with the accompanying drawings, in order to fully understand the objects, features and effects of the present invention.

DETAILED DESCRIPTION OF THE PREFERRED EMBODIMENTS

Figure 1:
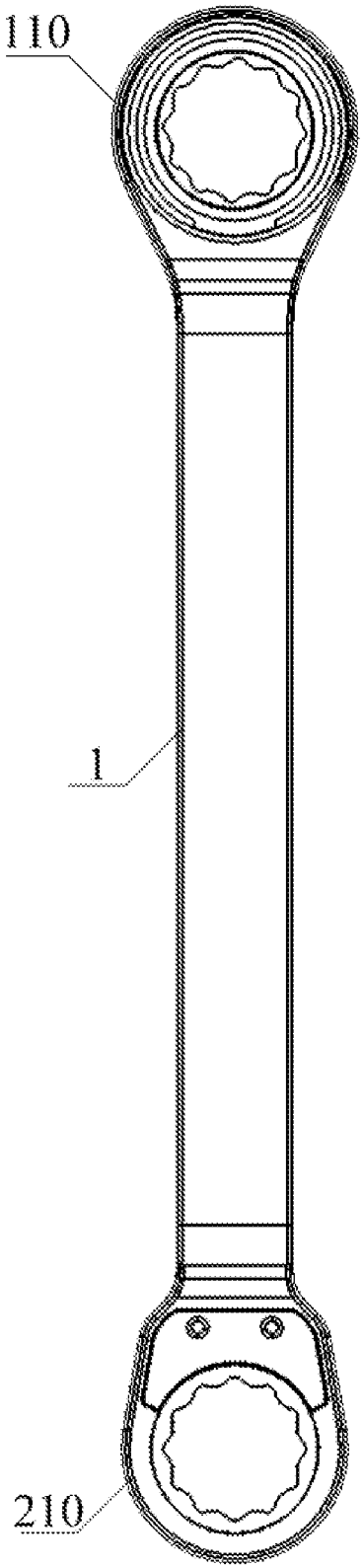
FIG. 1 is a front view of the wrench in the first embodiment of the present invention.
Figure 2:
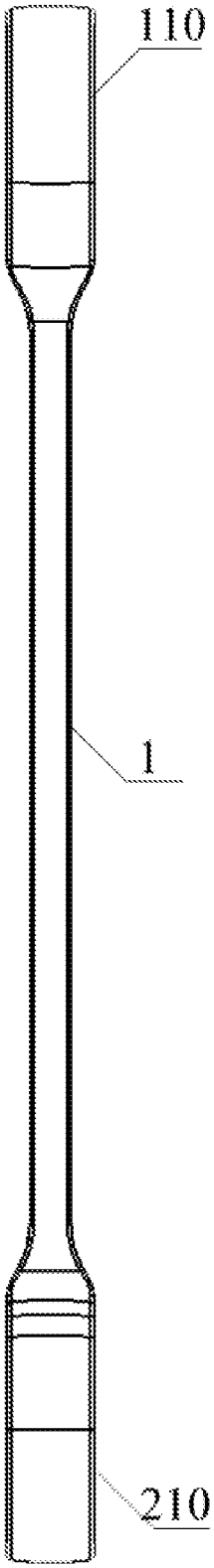
FIG. 2 is a side view of the wrench shown in FIG. 1.

As shown in FIGS. 1 and 2, in the first preferred embodiment, the wrench of the present invention is provided with two wrenching portions and a gripping portion 1 extending and connected to the two wrenching portions at its two extending ends. The two wrenching portions are both provided with a unidirectional transmission mechanism.

Figure 3:
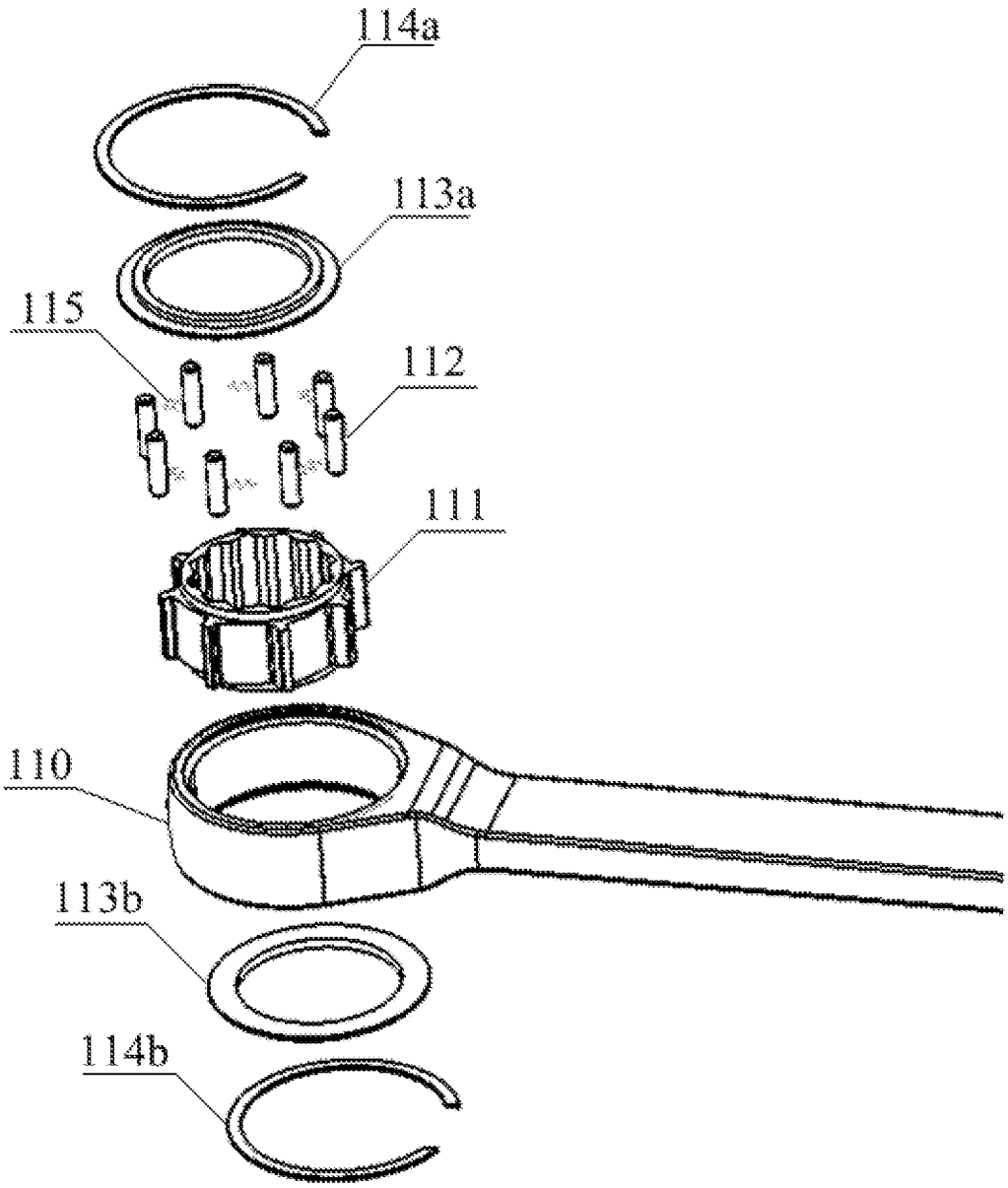
FIG. 3 is an exploded view of a structure of a wrenching portion of the wrench shown in FIG. 1.
Figure 4:
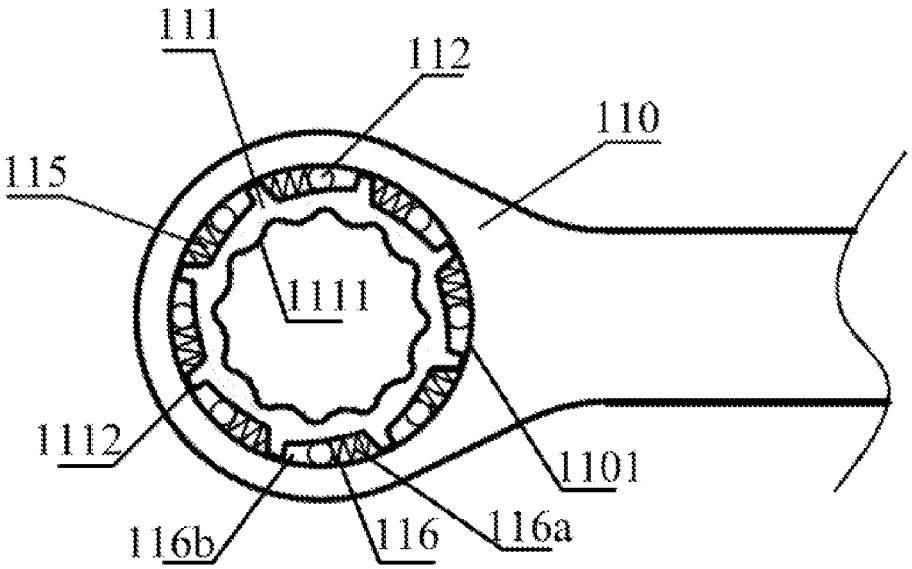
FIG. 4 shows a front view of the wrenching portion shown in FIG. 3.

The unidirectional transmission mechanism of the wrenching portion as shown in FIGS. 3 and 4 includes a plurality of rollers such as the roller 112, a first member 110 and a second member 111. The first member 110 is fixed to the wrenching portion, the second member 111 is sheathed in the first member 110, and the axis of rotation of the second member 111 and the axis of rotation of the first member 110 are parallel, preferably the two coincide. Specifically, the gripping portion 1 is connected with the first member 110, and the user applies a rotating torque to the first member 110 by rotating the gripping portion 1. The direction of the rotating torque along the axis of rotation thereof includes a first direction and a second direction, where the first direction is inwardly perpendicular to the paper in FIG. 4, i.e., a clockwise direction; the second direction is outwardly perpendicular to the paper in FIG. 4, i.e., a counterclockwise direction.

A first surface 1101 of the first member 110 facing the second member 111 is a smooth curved surface, in this example a cylindrical surface, and a second surface 1112 of the second member 111 facing the first member 110 has a plurality of grooves, such as groove 116. These grooves are distributed in a direction perpendicular to the axis of rotation of the first member 110, in this example they are distributed on the periphery perpendicular to the axis of rotation the second member 111. The second surface 1112 and the first surface 1101 are opposed to each other, and each of the grooves together with the first surface 1101 it is opposed to defines a movement room for the roller, such as the movement room 116. The movement room is designed to be provided with a larger first part and a smaller second part, for example, the movement room 116 has a first part **116*a* and a second part 116*b*. The rollers in the movement room, such as the roller 112, can be driven to move from the first part to the second part of the movement room or from the second part to the first part due to the friction force of the first surface 1101 the roller 112 is subjected to. The roller in the first part of the movement room thereof can rotate freely, and the roller in the second part is sandwiched between the first member 110 and the second member 111. The roller sandwiched between the first member 110 and the second member 111 is deformed by the frictional force from self-locking, forming a dead lock, whereby the second member 111 is stationary relative to the first member 110, and the rotating torque can be output to the workpiece through the unidirectional transmission mechanism; while the freely rotatable roller is not dead locked, and the second member 111 is rotatable relative to the first member 110**, whereby the rotating torque from the wrenching portion cannot be output to the workpiece.

The roller in this embodiment is a ball roller, a pin roller or a needle roller, which is a rotary body and may be cylindrical, spherical or stepped. Preferably, the first part of the movement room in which each roller is located is further provided with a laterally arranged elastic member, such as a spring 115, which abuts against the roller so that the roller is sandwiched between the first member 110 and the second member 111. Here the "laterally" refers to the extending of the spring in a direction from the first part to the second part of the movement room in which the spring is located, that is, the direction of its restoring force is the direction from the first part to the second part.

The second member 111 has a third surface 1111 for mating with the workpiece, as shown in FIG. 4, which is a surface away from the first member 110 in this example. When in use, it is sheathed at the end of a workpiece, such as a nut, to drive the workpiece to rotate. When the rotating torque of the first member 110 as shown in FIG. 4 is in the first direction, the roller is sandwiched between the first member 110 and the second member 111, thereby transmitting the rotating torque from the first member 110 to the second member 111, and the second member 111 driving the workpiece to rotate clockwise. When the rotating torque of the first member 110 as shown in FIG. 4 is in the second direction, the roller is driven by the first member 110 to detach from the sandwiching of the first member 110 and the second member 111, whereby the rotating torque from the first member 110 cannot be transmitted to the second member 111, and the workpiece is not rotated.

Preferably, as shown in FIG. 3, the retaining rings 113*a*, 113*b* and the snap springs 114*a*, 114*b* are further provided. The retaining rings 113*a*, 113*b* respectively abut against one end face of the second member 111 to confine the second member 111 in the first member 110, and the snap springs 114*a*, 114*b* are used for abutting against the retaining rings 113*a*, 113*b*, respectively, which mate with the annular grooves provided in the wrenching portion (in this embodiment, specifically, on the first surface 1101 of the first member 110) and are embedded in the corresponding annular grooves to restrict the movement of the retainers 113*a*, 113*b* and the second member 111 in the direction of the axis of rotation, thereby preventing the retaining rings 113*a*, 113*b* and the second member 111 from detaching from the wrenching portion in the direction of the axis of rotation.

Figure 5:
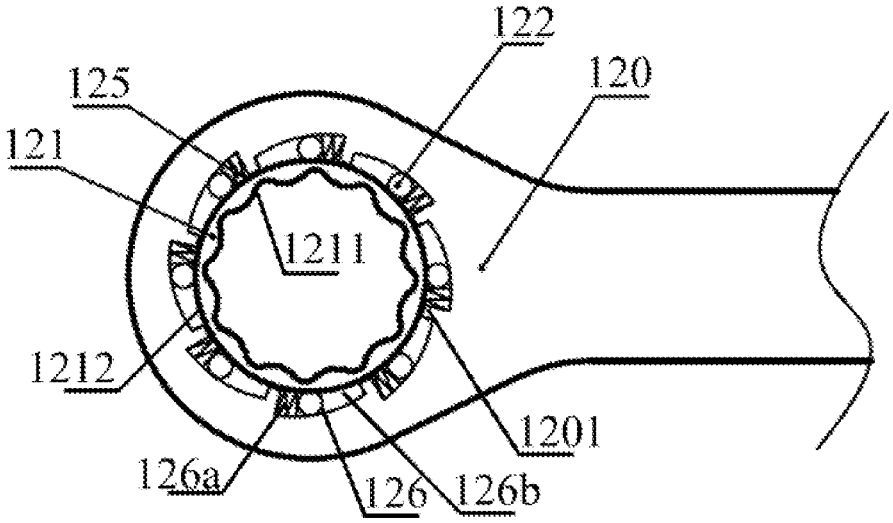
FIG. 5 is a front view of a second structure of a wrenching portion of the wrench shown in FIG. 1.

FIG. 5 shows another structure of the unidirectional transmission mechanism of the wrenching portion, which includes a plurality of rollers such as the roller 122, the first member 120, and the second member 121, wherein the first member 120 is fixed to the wrenching portion, the second member 121 is sheathed in the first member 120, and the axis of rotation of the second member 121 and the axis of rotation of the first member 120 are parallel, preferably the two coincide. Specifically, the gripping portion 1 is connected with the first member 120, and the user applies a rotating torque to the first member 120 by rotating the gripping portion 1. The direction of the rotating torque in the direction of its axis of rotation includes a first direction and a second direction, where the first direction is inwardly perpendicular to the paper in FIG. 5, i.e., in the clockwise direction; the second direction is outwardly perpendicular to the paper in FIG. 5, i.e., in the counterclockwise direction.

The first surface 1212 of the second member 121 facing the first member 120 is a smooth curved surface, which in this example is a cylindrical surface. The second surface 1201 of the first member 120 facing the second member 121 has a plurality of grooves, such as grooves 126. These grooves are distributed in a direction perpendicular to the axis of rotation of the first member 120, which in this example are distributed on the periphery of the axis of rotation perpendicular to the second member 121. The second surface 1201 and the first surface 1212 are opposed to each other, and each of the grooves together with the first surface 1212 it is opposed to defines a movement room for the roller, such as the movement room 126. The movement room is designed to have a larger first part and a smaller second part, such as the movement room 126 having a first part 126*a* and a second part 126*b*. The rollers in the movement room, such as the roller 122, can be driven to move from the first part of the movement room to the second part of the movement room or from the second part to the first part due to the friction force of the first surface 1212 the roller 122 is subjected to. The rollers in the first part of the movement room can rotate freely and the rollers in the second part are sandwiched between the first member 120 and the second member 121. The roller sandwiched between the first member 120 and the second member 121 is deformed by the frictional force from self-locking to form a dead lock, thereby causing the second member 121 to be stationary relative to the first member 120, and the rotating torque from the wrenching portion can be output to the workpiece through the unidirectional transmission mechanism. The freely rotatable roller is not dead locked, and the second member 121 is rotatable relative to the first member 120, whereby the rotating torque from the wrenching portion cannot be output to the workpiece.

The roller in this embodiment is a ball roller, a pin roller or a needle roller, which is a rotary body and may be cylindrical, spherical or stepped. Preferably, the first part of the movement room in which each roller is located is further provided with a laterally arranged elastic member, such as the spring 125, which abuts against the roller so that the roller is sandwiched between the first member 120 and the second member 121. Here the "laterally" refers to the extending of the spring in a direction from the first part to the second part of the movement room where it is located, that is, the direction of its restoring force is the direction from the first part to the second part.

The second member 121 has a third surface 1211 for mating with the workpiece, as shown in FIG. 4, which is a surface away from the first member 120 in this example. When in use, it is sheathed at the end of a workpiece such as a nut to drive the workpiece to rotate. When the rotating torque of the first member 120 as shown in FIG. 5 is in the first direction, the roller is sandwiched between the first member 120 and the second member 121, thereby transmitting the rotating torque from the first member 120 to the second member 121, and the second member 121 causes the workpiece to rotate in the clockwise direction; when the rotating torque of the first member 120 as shown in FIG. 5 is in the second direction, the roller is driven by the first member 120 to detach from the sandwiching of the first member 120 and the second member 121, whereby the rotating torque from the first member 120 cannot be transmitted to the second member 121, and the workpiece is not rotated.

In the above two examples, the grooves on the surface of the first member or the second member are U-shaped grooves having a bottom surface and side surfaces at both sides of the bottom surface. In the third structure of the unidirectional transmission mechanism of the wrenching portion shown in FIG. 6, the grooves arranged on the second surface 1301 of the first member 130 are V-shaped, being also a workable structure. The second member 131, a plurality of rollers such as the roller 132, the first surface 1312 of the second member 131, and the third surface 1311 of the second member 131 for mating with the workpiece are all the same as in the previous example. Each of the grooves, together with the first surface 1312 it is opposed to defines a movement room for a roller, such as the movement room 136. The movement room is designed to have a larger first part and a smaller second part, such as the movement room 136 having a first part 136*a* and a second part 136*b*. Preferably, the first part of the movement room in which each roller is located is further provided with a laterally arranged elastic member which abuts against the roller so that the roller is sandwiched between the first member 130 and the second member 131, such as the U-shaped spring 135 shown in FIG. 7. The spring extends in a direction from the first part to the second part of the room in which it is located, that is, the direction of its restoring force is from the first part to the second part.

Figure 8:
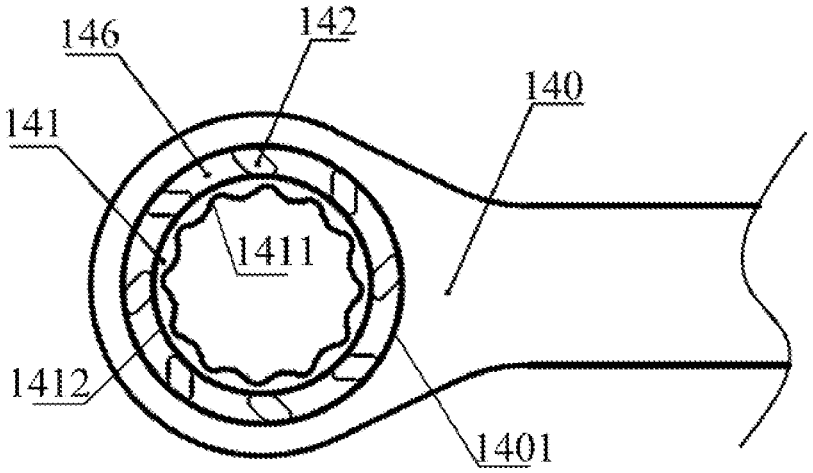
FIG. 8 is a front view of a fourth structure of a wrenching portion of the wrench shown in FIG. 1.

FIG. 8 shows a fourth structure of the unidirectional transmission mechanism of the wrenching portion, which includes a plurality of rollers such as the roller 142, the first member 140 and the second member 141. The first member 140 is fixed to the wrenching portion, the second member 141 is sheathed in the first member 130, and the axis of rotation of the second member 141 and the axis of rotation of the first member 140 are parallel, preferably the two coincide. Specifically, the gripping portion 1 is connected with the first member 140, and the user applies a rotating torque to the first member 140 by rotating the gripping portion 1. The direction of the rotating torque in the direction of its axis of rotation includes a first direction and a second direction, where the first direction is inwardly perpendicular to the paper in FIG. 8, i.e., in the clockwise direction; the second direction is outwardly perpendicular to the paper in FIG. 8, i.e., in the counterclockwise direction.

The first surface 1401 of the first member 140 facing the second member 141 is a smooth curved surface, which in this example is a cylindrical surface. The second surface 1412 of the second member 141 facing the first member 140 is a smooth curved surface, which in this example is a cylindrical surface. In this example, the second surface 1412 and the first surface 1401 are parallel to each other and their axes of symmetry are both the rotational axis of the second member 141 and the first member 140. Each of the rollers is distributed between the first surface 1401 and the second surface 1412, and an elastic member (not shown), such as a spring, is connected between any two adjacent rollers, and the spring extends from one of the rollers to the other roller. The roller is a profiled roller, as shown in FIG. 8, the cross-section of which perpendicular to the axis of rotation has a maximum width and a minimum in which the maximum width is greater than the distance between the first surface 13401 and the second surface 1412, and the minimum width is less than the distance between the first surface 1401 and the second surface 1412. Preferably, the springs between the rollers are in a pressed state and each of the rollers is sandwiched between the first member 140 and the second member 141, specifically, sandwiched between the first surface 1401 and the second surface 1412. The roller between the first surface 1401 and the second surface 1412 can be driven and rotated due to the friction force of the first surface 1401 the roller is subjected to. The rotation of the roller may be a rotation in a direction along which the included angle (the acute angle) between the axis in the direction of the maximum width of the cross-section thereof and the normal line of the first surface 1401 where the roller is located gradually increases, or on the contrary.

The second member 141 has a third surface 1311 for mating with the workpiece, as shown in FIG. 8, which is a surface away from the first member 140 in this example. When in use, it is sheathed at the end of a workpiece such as a nut to drive the workpiece to rotate. When the rotating torque of the first member 140 as shown in FIG. 8 is the first direction, the roller is rotated in such a direction that the angle between the axis of the roller in the direction of the maximum width of the cross-section and the normal line of the first surface 1401 where it is located gradually decreases, or has a tendency to rotate in such a direction, thereby being securely sandwiched between the first surface 1401 and the second surface 1412 and being able to transmit the rotating torque from the first member 140 to the second member 141 which causes the workpiece to rotate in the clockwise direction; when the rotating torque of the first member 130 as shown in FIG. 8 is the second direction, the roller is driven by the first member 140 to rotate in such a direction that the angle between the axis of the roller in the direction of the maximum width of the cross-section and the normal line of the first surface 1401 where it is located gradually increases, thereby detaching from the sandwiching of the first surface 1401 and the second surface 1412 and being unable to transmit the rotating torque from the first member 140 to the second member 141, and the workpiece is not rotated.

Figure 9:
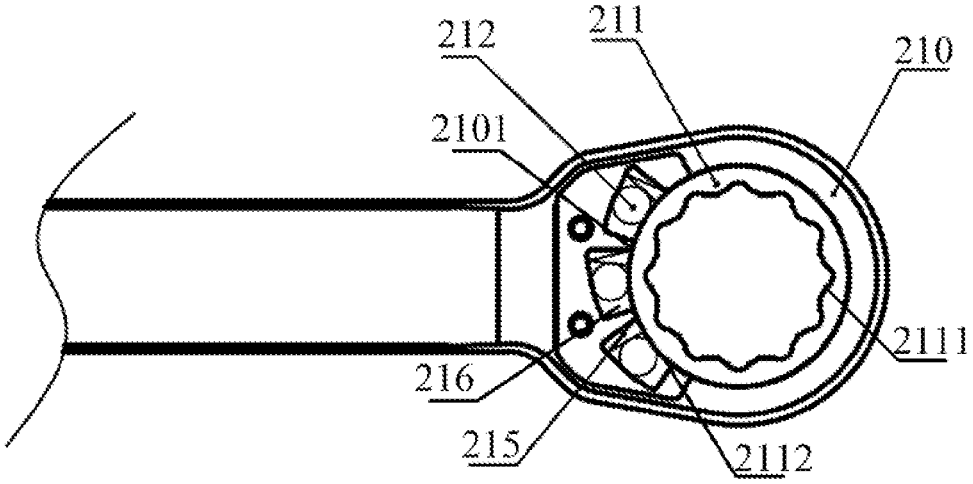
FIG. 9 is a front view of the structure of the other wrenching portion of the wrench shown in FIG. 1.
Figure 10:
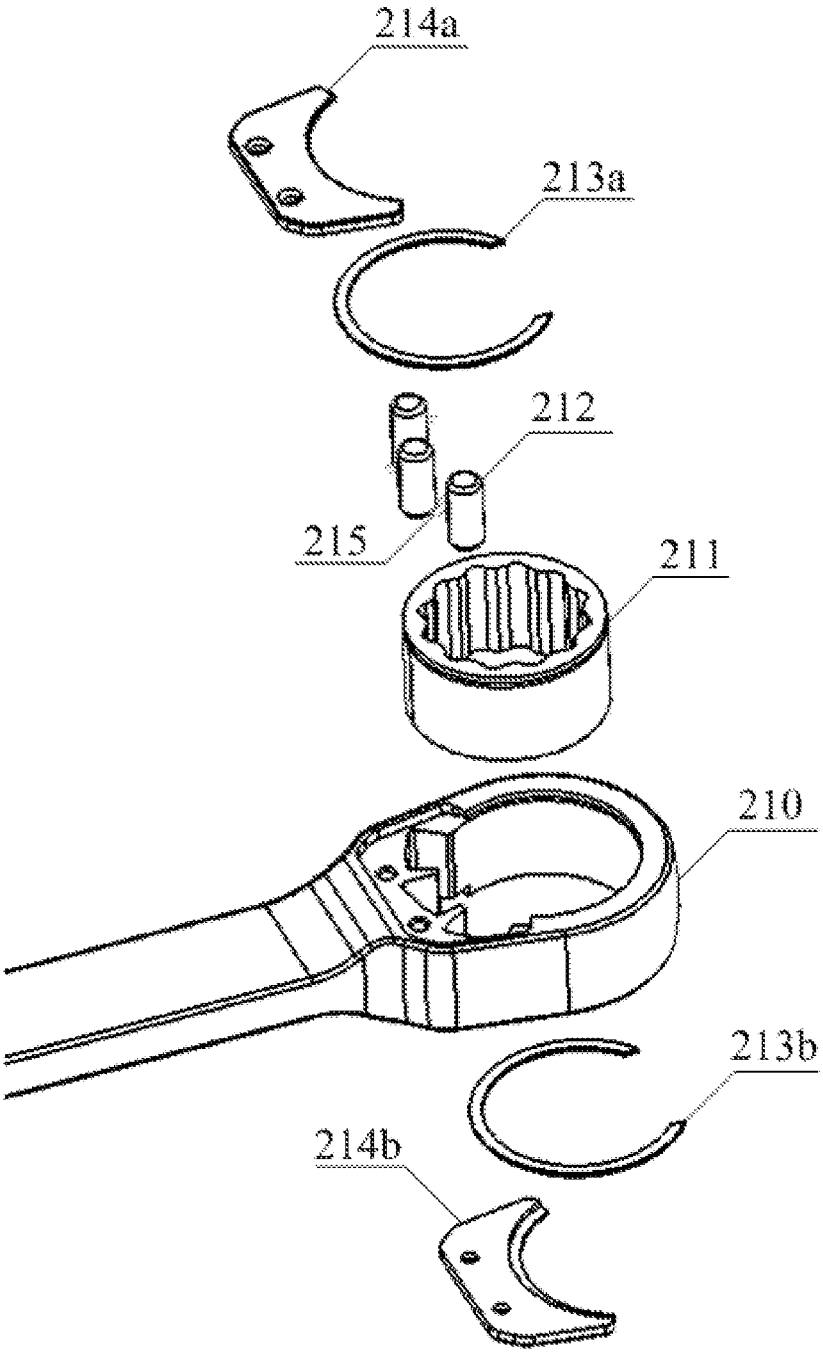
FIG. 10 is an exploded view of the wrenching portion shown in FIG. 9.

The unidirectional transmission mechanism of the wrenching portion shown in FIGS. 9 and 10 includes a plurality of rollers such as the roller 212, a first member 210 and a second member 211. The first member 210 is fixed to the wrenching portion, the second member 211 is sheathed in the first member 210, and the axis of rotation of the second member 211 and the axis of rotation of the first member 210 are parallel, preferably the two coincide. Specifically, the gripping portion 1 is connected with the first member 210, and the user applies a rotating torque to the first member 210 by rotating the gripping portion 1. The direction of the rotating torque in the direction of its axis of rotation includes a first direction and a second direction, where the first direction is inwardly perpendicular to the paper in FIG. 9, i.e., in the clockwise direction; the second direction is outwardly perpendicular to the paper in FIG. 9, i.e., in the counterclockwise direction.

The structure of the unidirectional transmission mechanism shown in FIGS. 9 and 10 is similar to that shown in FIG. 5, except that the plurality of grooves such as the groove 216 on the second surface 2101 of the first member 210 of the unidirectional transmission mechanism shown in FIGS. 9 and 10 are distributed only on a portion of the cross-section of the second surface 2101 perpendicular to the axis of rotation of the first member 210 adjacent to the portion of the gripping portion 1, which in this example are distributed on a portion of the periphery, specifically, on the part adjacent to the gripping portion 1. The number of grooves is preferably 3. In addition to the above described, the structure and operating principle of the second member 211, the first member 210, the plurality of rollers such as the roller 212 and the plurality of elastic members such as the spring 215, of the unidirectional transmission mechanism, are the same as the unidirectional transmission mechanism shown in FIG. 5, which are not to be described in details here.

As shown in FIG. 10, the wrenching portion further includes snap springs 213*a*, 213*b* and fixing plate 214*a*,

214*b*, and the snap springs 113*a*, 113*b* are respectively in contact with one end face of the second member 211 and mating with the annular groove arranged on the surface 2101 of the first member 210, embedded into the corresponding annular groove to restrict the movement of the second member 211 in the direction of the axis of rotation; on the outer sides of the snap springs 113*a*, 113*b*, the fixing plate 214*a*, 214*b* are respectively fixed to the wrenching portion, as shown in FIG. 10, a fixed connection between them is achieved by passing screws through the threaded holes of the fixing plate 214*a*, 214*b* and the wrenching portion.

Figure 6:
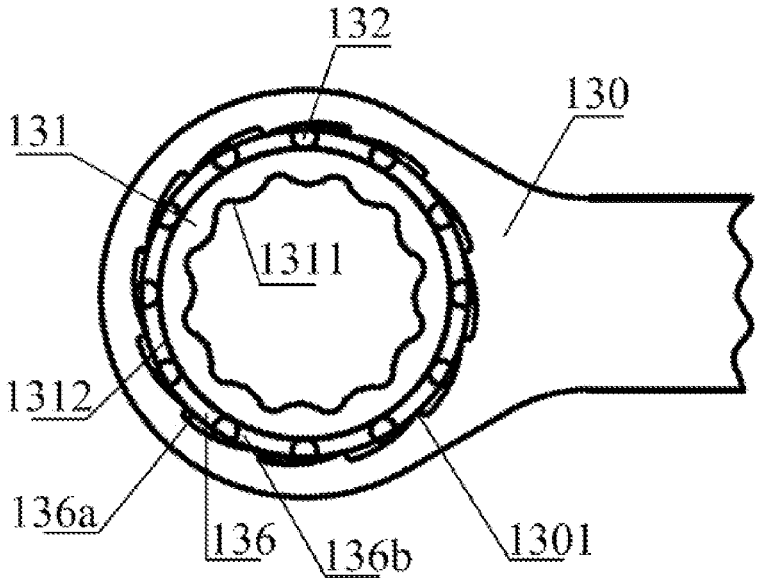
FIG. 6 is a front view of a third structure of a wrenching portion of the wrench shown in FIG. 1.
Figure 7:
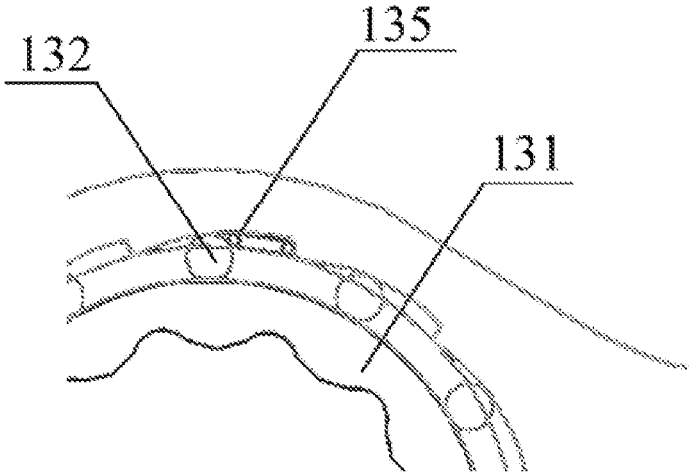
FIG. 7 is a partial enlarged view of the structure shown in FIG. 6.

In addition, the unidirectional transmission mechanism shown in FIGS. 4, 6 and 8 may be designed similarly to the structure shown in FIG. 9, that is, the rollers and the grooves are only distributed on the part, adjacent to the gripping portion, of the cross-section of the second surface perpendicular to the axis of rotation. In the case where the unidirectional transmission mechanism shown in FIG. 4 is designed to be similar to the structure shown in FIG. 9, grooves are provided on surface of the second member facing the first member, each groove corresponds to a roller and an elastic member, the number of the groove is preferably 3 In the case where the unidirectional transmission mechanism shown in FIG. 6 is designed to be similar to the structure shown in FIG. 9, grooves are provided on surface of the first member facing the second member, each groove corresponds to a roller and an elastic member, the number of the groove is preferably 3. In the case where the unidirectional transmission mechanism shown in FIG. 8 is designed to be similar to the structure shown in FIG. 9, one groove is provided on surface of the second member facing the first member or one groove is provided on the surface of the first member facing the second member, a plurality of rollers (for example, 3) are arranged in the groove and an elastic member is connected between the rollers. In addition to the above described, the structure and operating principle of the second member, the first member, the plurality of rollers and the plurality of springs of the unidirectional transmission mechanism are the same as those of the unidirectional transmission mechanism shown in FIGS. 4, 6 and 8 which are not to be described in details. Such structure of the unidirectional transmission mechanism enables the wrench to be not provided with rollers in the head portion of the wrench, so the structure of the head can be made small, which can be used in a small space for a wider range of application.

Figure 11:
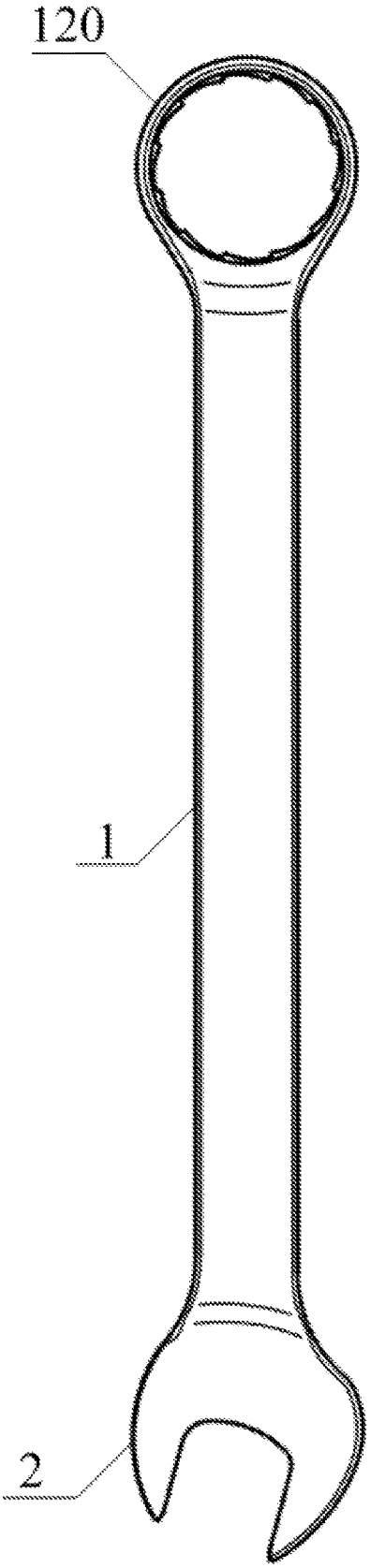
FIG. 11 is a front view of the wrench in the second embodiment of the present invention.
Figure 12:
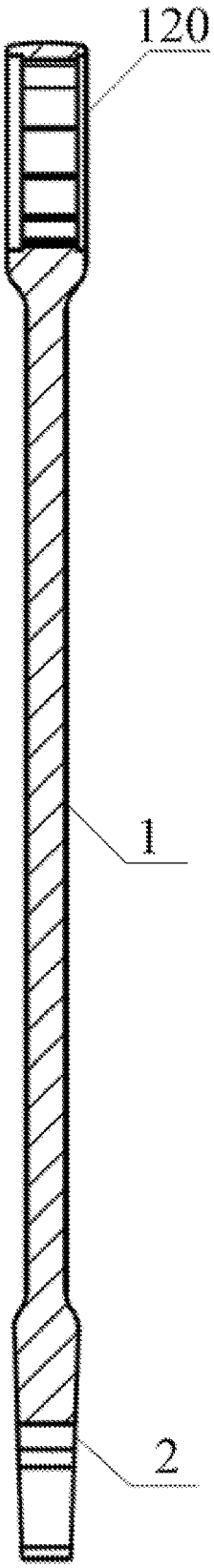
FIG. 12 is a sectional view of the wrench shown in FIG. 11.

As shown in FIGS. 11 and 12, in the second preferred embodiment, the wrench of the present invention has two wrenching portions, and the gripping portion 1 extends and connected with the two wrenching portions at its two extending ends. One of the wrenching portions is provided with a unidirectional transmission mechanism as described in the previous embodiment, and the other of the wrenching portions is not provided with a unidirectional transmission mechanism, and instead is a structure of a conventional wrenching portion.

Figure 13:
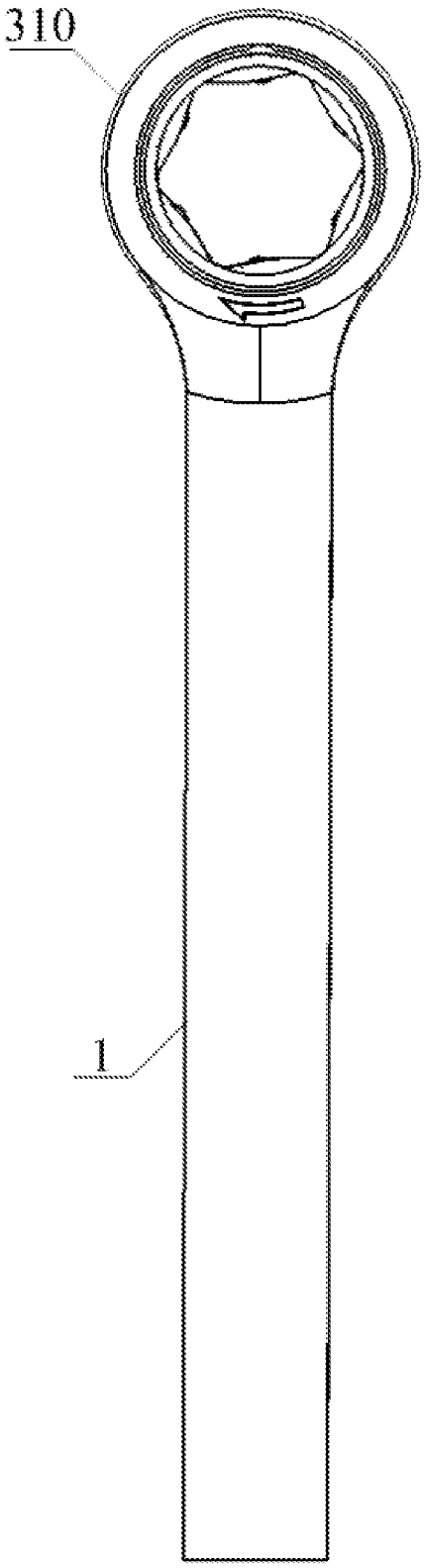
FIG. 13 is a front view of the wrench in the third embodiment of the present invention.
Figure 14:
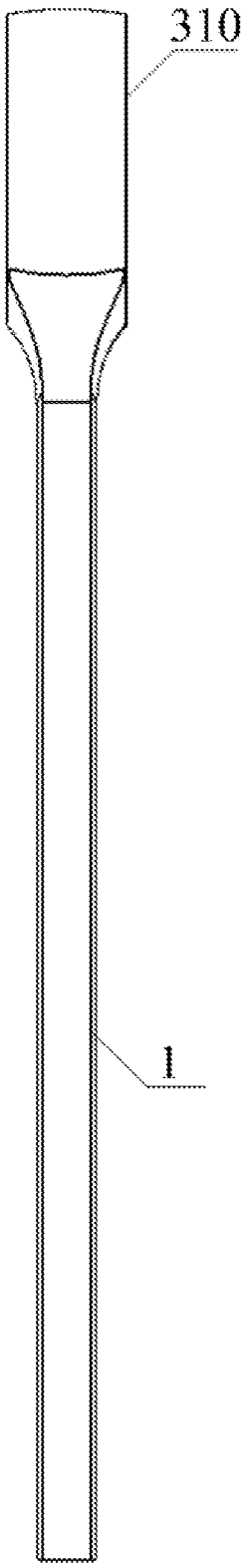
FIG. 14 is a side view of the wrench shown in FIG. 12.

As shown in FIGS. 13 and 14, in the third preferred embodiment, the wrench of the present invention has one wrenching portion which extends and is connected at its extended end with the wrenching portion, where a unidirectional transmission mechanism is provided on the wrenching portion.

Figure 15:
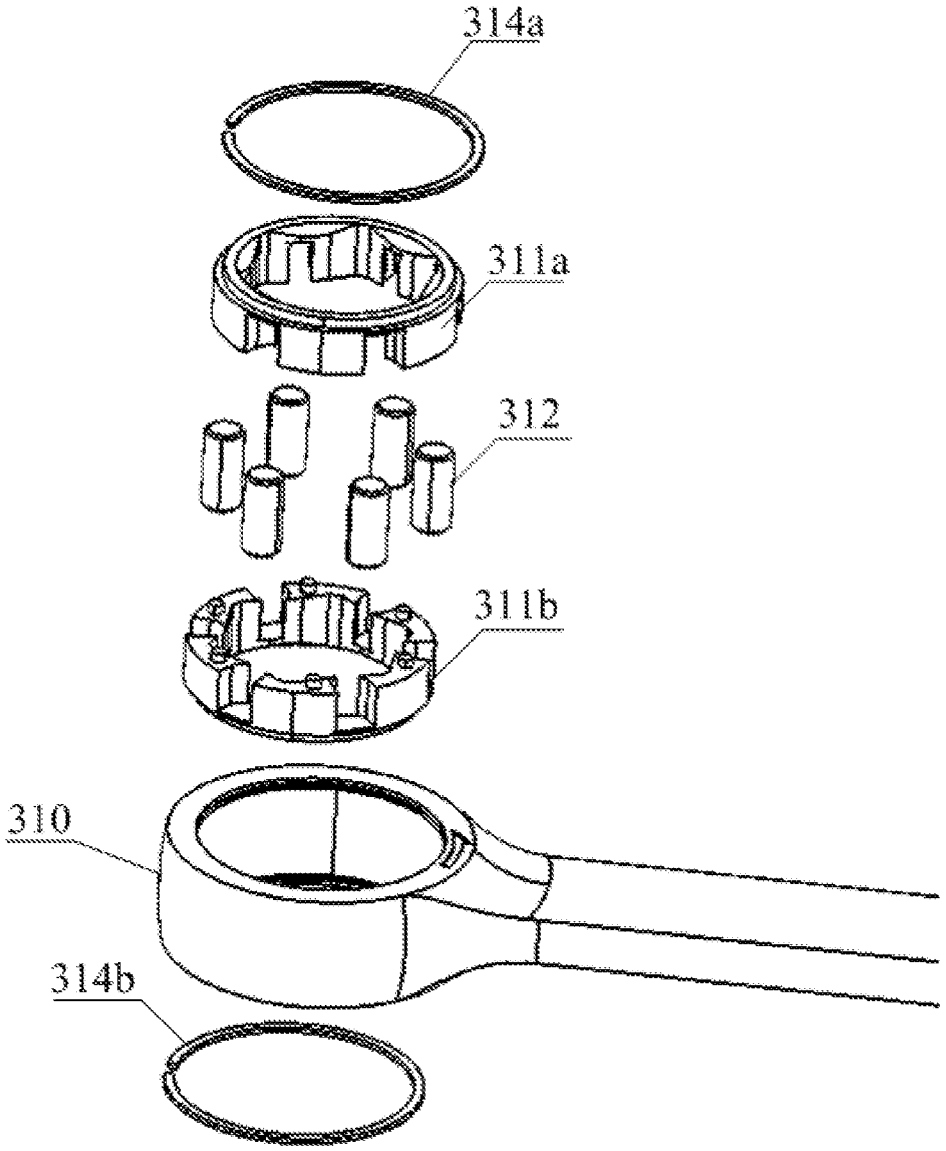
FIG. 15 is an exploded view of a structure of the wrenching portion of the wrench shown in FIG. 13.

The unidirectional transmission mechanism of the wrenching portion shown in FIG. 15 includes a plurality of rollers, such as the roller 312, a first member 310 and a second member, in which the second member includes a holder formed by a first part 311*a* and a second part 311*b* that are engaged with each other. The first member 310 is fixed to the wrenching portion, the second member is sheathed in the first member 310, and the axis of rotation of the second member is parallel to the axis of rotation of the first member 310, preferably the two coincide. Specifically, the gripping portion 1 is connected with the first member 310, and the user applies a rotating torque to the first member 310 by rotating the gripping portion 1. The direction of the rotating torque in the direction of its axis of rotation includes a first direction and a second direction, in which the first direction is inwardly perpendicular to the paper as in FIGS. 18-21, i.e., in the clockwise direction; the second direction is outwardly perpendicular to the paper as in FIGS. 18-21, i.e., in the counterclockwise direction.

Figure 20:
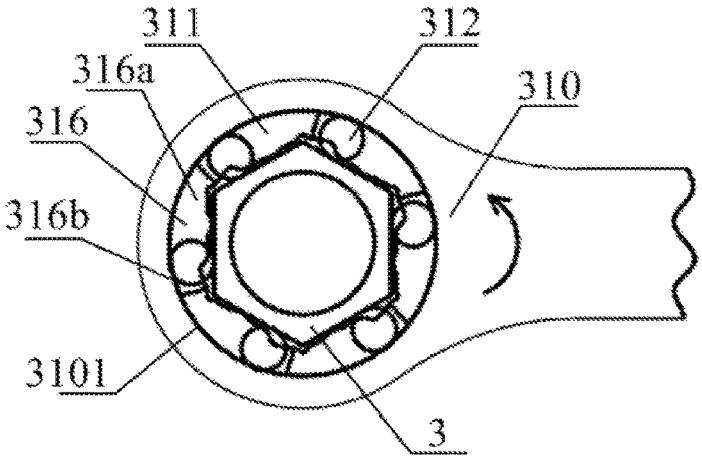
FIG. 20 shows a front view of the wrenching portion shown in FIG. 13, where the wrenching portion is not rotated.

FIG. 20 shows a front view of the unidirectional transmission mechanism in a stationary state, in which the mating workpiece 3 is shown. As can be seen in FIGS. 15 and 20, the first surface 3101 of the first member 310 facing the second member is a smooth curved surface, which in this example is a cylindrical surface; the holder of the second member is an annular body which is provided with a plurality of spaces spaced apart from each other in a direction perpendicular to the axis of rotation of the first member 310 and the second member, and each of the rollers is accommodated in the respective space, here the space is similar to the space 3212 on the second member shown in FIG. 25. Each of the spaces has a first opening facing the first member 310 and a second opening facing the workpiece 3. Thus, the space confined by the first surface 3101 and the surface of the workpiece becomes the movement room for the roller, such as the movement room 316. In this example, the movement room has a partly cylindrical shape (with an arcuate cross-section), the movement room is designed to have a larger first part and a smaller second part, such as the movement room 316 having a first part 316*a* and a second part 316*b*. The roller comes into contact with the first surface 3101 through the first opening of the space in which it is located and thereby can be driven by the first member 320, and the roller comes into contact with the workpiece 3 through the second opening. The first part 310 can drive the roller to move from the first part to the second part of the space in which it is located or from the second part to the first part by the friction between the two. The rollers in the first part can rotate freely and the rollers in the second part are sandwiched between the first member 310 and the workpiece 3. As shown in FIG. 20, in the case where the roller in the movement room 316 is located in the second part 316*b*, when the first member 310 is rotated in the counterclockwise direction, the roller exhibits a tendency to move from 316*b* to 316*a* under the action of the frictional force, the roller is locked and the workpiece 3 is driven to rotate together; when the first member 310 is rotated in the clockwise direction, the roller exhibits a tendency to move from 316*a* to 316*b* under the action of frictional force, the roller rotates freely and the workpiece 3 and the holder together move relative to the first member 310 to achieve the ratchet function. It can be seen that when it is desired to tighten the workpiece clockwise, it is sufficient to dispose the roller in the first part such as the first part 316*a*.

Figure 16:
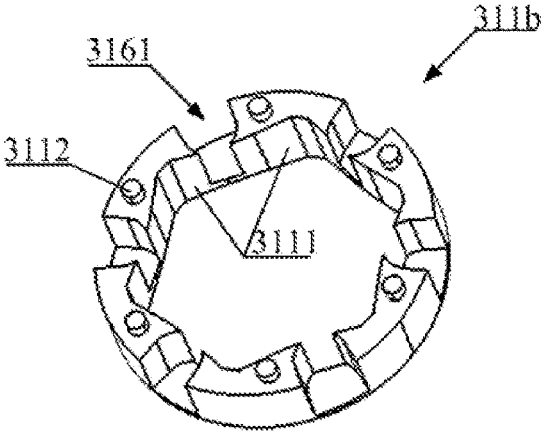
FIG. 16 is a perspective view of the second part of the holder of a unidirectional transmission mechanism of the wrench shown in FIG. 13.
Figure 17:
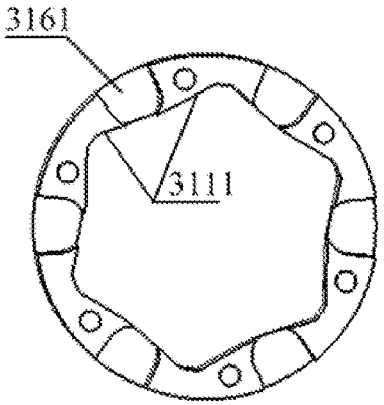
FIG. 17 is a front view of a second part of the holder shown in FIG. 16.
Figure 18:
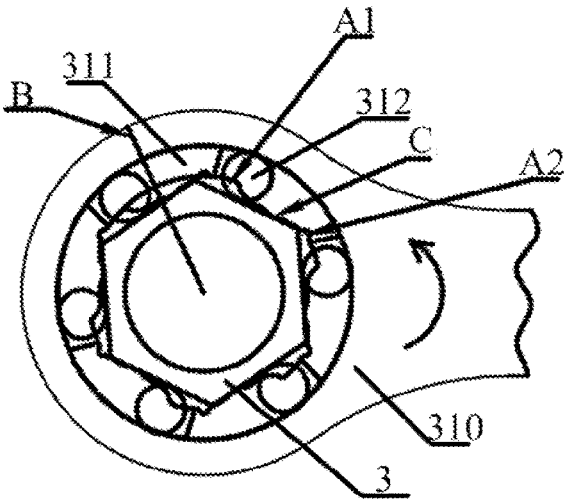
FIG. 18 shows the design principle of the unidirectional transmission mechanism shown in FIG. 13.

Specifically, FIGS. 16, 17 show the second part 311*b* of the holder; the structure of the first part 311*a* is symmetrical with the second part 311*b* except that the surface of the second part 311*b* for engaging with the first part 311*a* has a plurality of protrusions such as protrusion 3112, and the engaging surface of the first part 311*a* has recesses for mating with these protrusions. The second part 311*b* has a plurality of grooves, such as groove 3161, which are correspondingly engaged with the grooves in the first part 311*a* one by one to form movement rooms for accommodating the rollers, such as the movement room 316 (see FIG. 20). The second part 311*b* has an inner surface facing the workpiece and an outer surface facing the first member 310 with a gap between the outer surface and the first surface 3101 of the first member 310, that is, the two are not in contact, and the inner surface has a shape matching the workpiece; the first part 311*a* is the same. For example, the unidirectional transmission mechanism in this example is used to mate with a hex nut (as shown in FIG. 18), so the inner surface of the second part 311*b* has six side walls, such as the side wall 3111, each of which corresponds to a side surface of the hex nut. In the front view of the second part 311*b* shown in FIG. 17, it can be seen that the inner surface thereof is an approximately positive hexagonal shape, and the first part 311*a* is the same, so the inner surface of the holder formed by the engagement of the two is approximately a regular hexagon in the cross-section perpendicular to the axis of rotation. However, in other examples of the present invention, the shape of the inner surface of the holder can be designed and determined according to the workpieces with which it is required to mate, which may also be other shapes.

Specifically, as shown in FIG. 18, after the unidirectional transmission mechanism of this example is mated with the workpiece 3, the inner surface of the holder is opposed to the surface of the workpiece 3, but the two are not fully contacted. In fact, in order to ensure the effective locking function of the roller and to facilitate the mating and detachment of mating of the workpiece 3 with the unidirectional transmission mechanism, the inner surface of the holder is designed to have clearance at a certain distance from the surface of the workpiece. In this example, each of the six side walls of the inner surface of the holder has two clearances which are not in contact with the side walls of the workpiece 3, such as the clearances A1 and A2, in which the clearance A1 is used to ensure that the workpiece 3 is not in contact with the holder when it is screwed, to prevent the locking function of the roller from failing. The clearance A2 is used to ensure that the hexagonal points of the workpiece 3 are not in contact with the holder when the workpiece 3 is placed into the unidirectional transmission mechanism, to facilitate the placement and removal of the workpiece 3. Each of the six side walls of the inner surface of the holder further has a protrusion pointing toward a side wall of the workpiece 3, such as the protrusion C. The protrusion C is between the clearances A1 and A2, and is closer to the workpiece 3 relative to the connection line of A1 and A2. In addition, the protrusions C between the clearances A1 and A2 are distributed on the side farther away from where the rollers are located, that is, as shown in FIG. 18, the bisector B is made between the clearances A1 and A2, which divides a side wall of the holder into two parts, and the contact area C is located at the portion of the two parts which is remote from the roller.

The design of the protrusions and clearances on the other side walls of the inner surface of the holder is the same, so that the six contact areas on the six side walls of the inner surface of the holder form a hexagon, which can ensure the initial position of the workpiece 3 when placed thereinto, avoiding the failure of dead locking function. This is because the dead locking can take effect only when the roller is in a small space, and if the roller is just in the maximum location in the middle, the dead locking will be invalid. In addition, these contact areas can also contact the workpiece when the ratchet is rotated, so that a separate holder is revolved to achieve ratcheting function. Of course, the workpiece may also touch other positions to drive the holder to revolve, to achieve ratcheting function. If the shape of the holder is designed symmetrically with respect to the bisector, its dead locking and ratchet functions can be interchanged.

Figure 19:
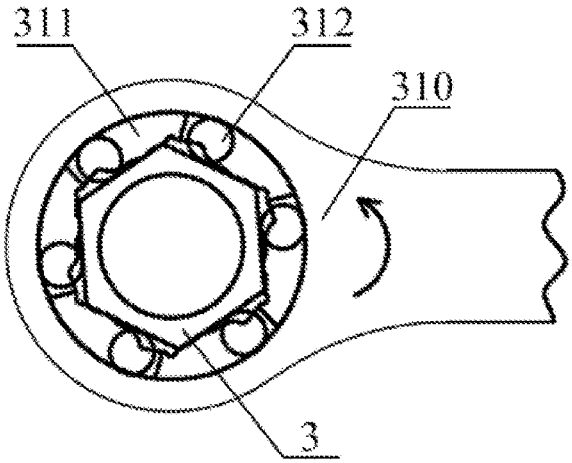
FIG. 19 shows a front view of the wrenching portion shown in FIG. 13, where the wrenching portion is idling.
Figure 21:
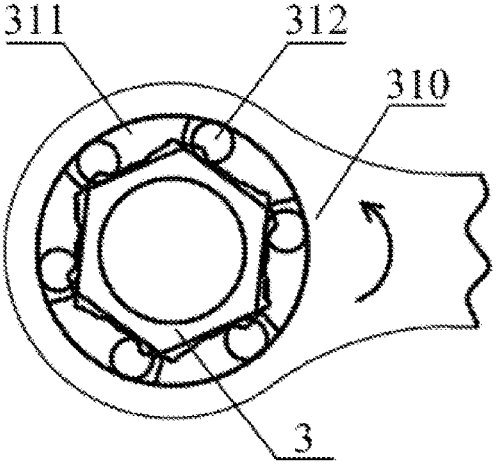
FIG. 21 shows a front view of the wrenching portion shown in FIG. 13, where the wrenching portion is rotated forward.
Figure 22:
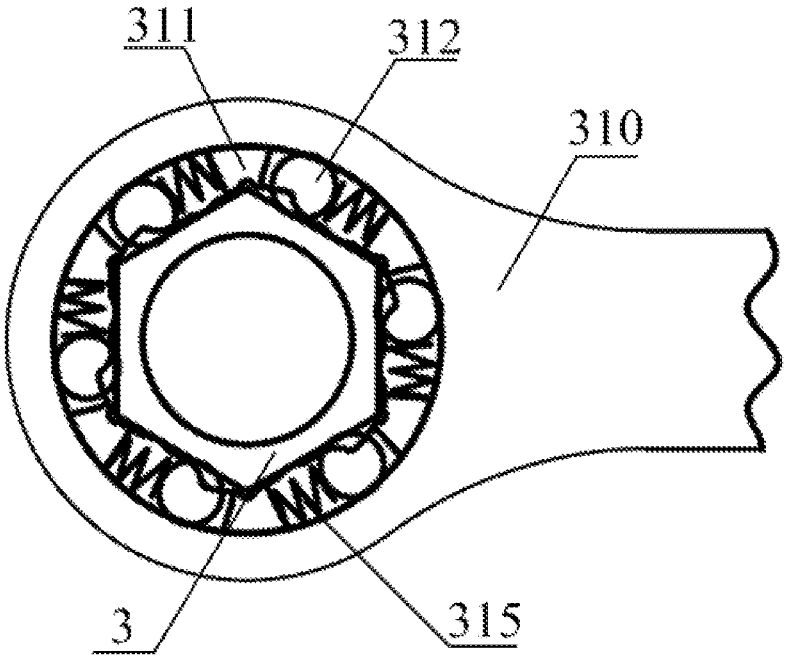
FIG. 22 is the second structure of the wrenching portion of the wrench shown in FIG. 13.

Specifically, as shown in FIG. 19, when the rotating torque from the wrench portion is in the first direction, that is, when the first member 310 is rotated in the direction contrary to the direction indicated by the arrow in the figure, the clamping forces between the first member 310, the roller and the workpiece 3 are released, and the workpiece 3 comes into contact with the holder of the second member after revolved by a small angle; in the case where the workpiece 3 is not revolved, the workpiece 3 together with the holder rotates relative to the first member 310, and then the roller starts rolling. That is, the roller is driven by the first part 310 into the first part of the movement room where it is located and can rotate freely. The roller is not dead locked and is rotatable relative to the first member 310, whereby the rotating torque from the wrenching portion cannot be output to the workpiece 3. The above-mentioned revolution is the revolution of the workpiece 3 relative to the first member 310 based on the rolling friction of the roller, and the resistance is small, which facilitates the realization of the ratchet function. As shown in FIG. 21, when the rotating torque from the wrench portion is in the second direction, that is, when the first member 310 is rotated in the direction indicated by the arrow in the drawing, the workpiece 3 and the holder of the second member are rotated relative to each other, forming a wedge-shaped movement room, and the roller is driven by the first member 310 into the second part of the movement room in which it is located, i.e., between the first member 310 and the workpiece 3. In this wedge-shaped movement room, the roller, due to the combined action of the workpiece 3 and the first member 310, has a tendency to move to a smaller portion in the movement room, which causes the roller to be sandwiched more tightly, that is, the roller is deformed by the self-locking friction to form a dead lock, whereby the roller is stationary relative to the first member 110 and the workpiece 3 and the rotating torque from the wrenching portion can be output to the workpiece 3 through it.

The roller in this embodiment is a ball roller, a pin roller or a needle roller, which is a rotary body and may be cylindrical, spherical or stepped. The width of the second opening is smaller than the diameter of the ball roller, the pin roller or the needle roller, so that the roller does not come out of the movement room when not mating with the workpiece.

In the present embodiment, the wrenching portion further includes snap springs 314*a*, 314*b* which respectively abut against one end face of the second member and mate with the annular groove provided on the first surface of the first member 310 which are embedded in the corresponding annular groove to confine the movement of the second member in the direction of the axis of rotation. Since the holder is in a split configuration, when mounting the second member and the roller, it can be accomplished by placing the roller into the space portion of the second part 311*b*, and then engage the first part 311*a* with the second part 311*b*.

Figure 23:
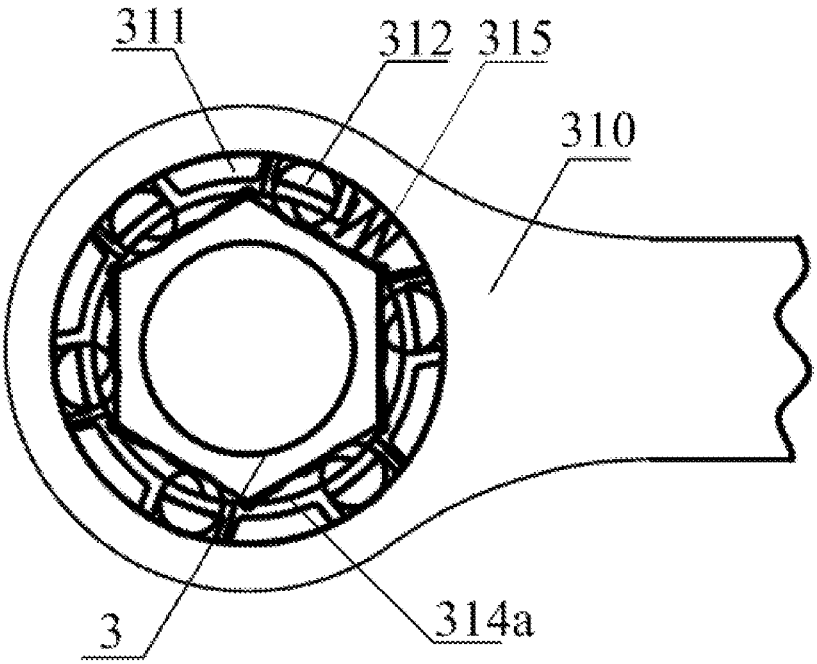
FIG. 23 is the third structure of the wrenching portion of the wrench shown in FIG. 13.
Figure 32:
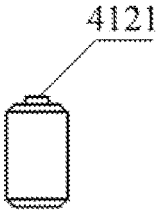
FIG. 32 shows a side view of the pin roller of the unidirectional transmission mechanism of the wrenching portion shown in FIG. 28.

Preferably, a laterally arranged elastic member is further provided in the first part of the movement room where the respective roller is located. As shown in FIG. 32, each of the elastic members respectively abuts against the respective roller so that the respective roller is sandwiched between the first member 310 and the workpiece 3, such as spring 315. The spring extends in a direction from the first part of the movement room in which it is located to the second part, i.e.

the direction of its restoring force is from the first part to the second part. Alternatively, an elastic member arranged laterally is provided in the first part of the movement room in which a roller is located, as shown in FIG. 23, and the spring 315 abuts against the roller 312 so as to be sandwiched between the first member 310 and the workpiece 3.

Figure 24:
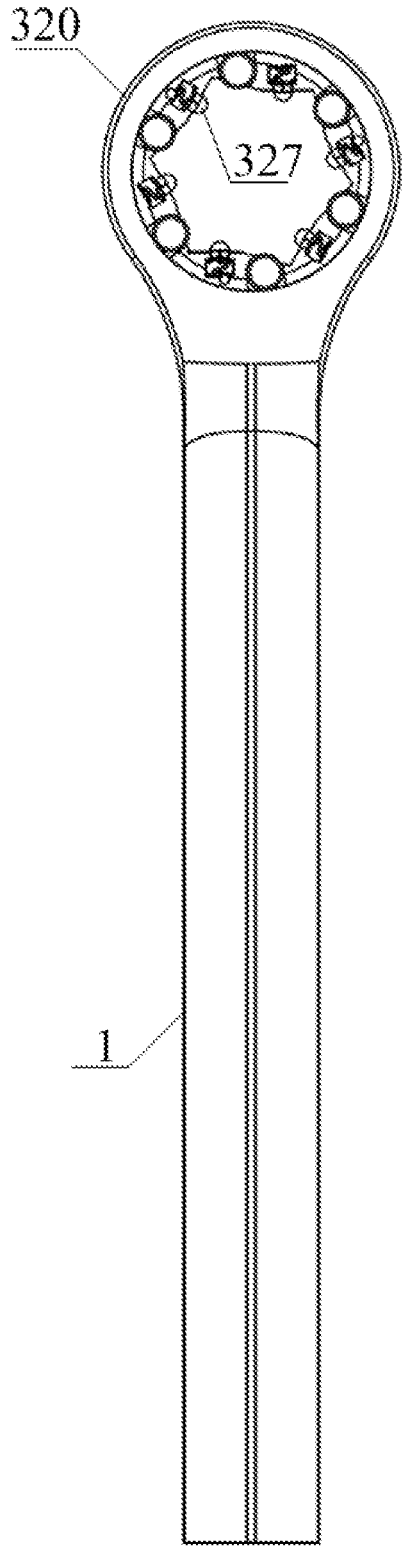
FIG. 24 is a front view of the wrench in a fourth embodiment of the present invention.

As shown in FIG. 24, in the fourth preferred embodiment, the wrench of the present invention has a wrenching portion, the gripping portion 1 extends and is connected at its extending end with the wrenching portion, and a unidirectional transmission mechanism is provided on the wrenching portion.

Figure 25:
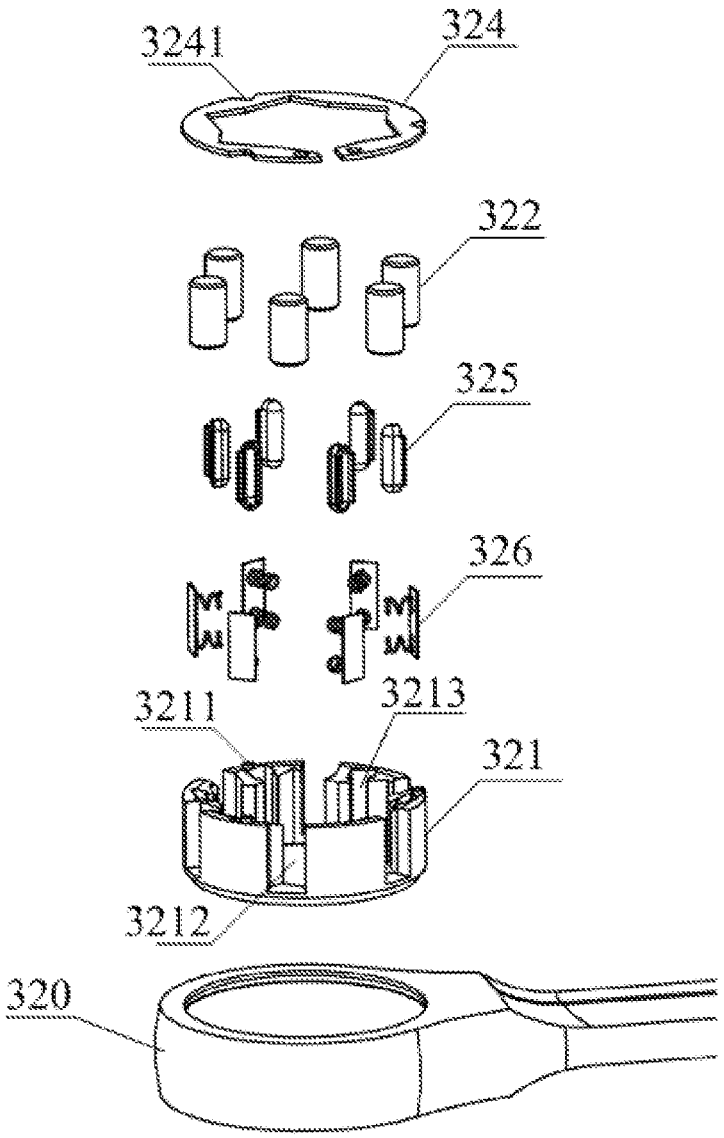
FIG. 25 is an exploded view of the structure of the wrenching portion of the wrench shown in FIG. 24.

The unidirectional transmission mechanism of the wrenching portion shown in FIG. 25 includes a plurality of rollers, such as the roller 322, a first member 320 and a second member, in which the second member includes a holder 321. The first member 320 is fixed to the wrenching portion, the second member is sheathed in the first member 320, and the axis of rotation of the second member 321 and the axis of rotation of the first member 320 are parallel to each other, preferably the two coincide. Specifically, the gripping portion 1 is connected with the first member 320, and the user applies a rotating torque to the first member 320 by rotating the gripping portion 1. The direction of the rotating torque in the direction of its axis of rotation includes a first direction and a second direction, in which the first direction is downward as in FIG. 25, i.e., in the clockwise direction; the second direction is upward as in FIG. 25, i.e., in the counterclockwise direction.

The first surface of the first member 320 facing the second member is a smooth curved surface, which in this example is a cylindrical surface; the holder 321 is an annular body, on which a plurality of spaces spaced apart are disposed in a direction perpendicular to the axis of rotation of the first member 320 and the second member, each of the rollers is accommodated in each of the spaces such as the space 3212, respectively. Each of the spaces has a first opening facing the first member 320 and a second opening facing the workpiece, whereby the space confined by the first surface and the surface of the workpiece becomes the movement room for the roller. As in the previous example, the movement room is designed to have a larger first part and a smaller second part. The roller contacts the first surface through the first opening of the space in which it is located and thereby can be driven by the first member 320, and the roller contacts the workpiece through the second opening. The first member 320 can drive the roller to move from the first part to the second part of the space in which it is located or from the second part to the first part by the friction between the two. The rollers in the first part can rotate freely and the rollers in the second part are sandwiched between the first member 320 and the workpiece.

The roller in this embodiment is a ball roller, a pin roller or a needle roller, which is a rotary body and may be cylindrical, spherical or stepped. The second member further includes an elastic ejector pin disposed on the holder 321, such as the elastic ejector pin 327 shown in FIG. 24, for abutment against the workpiece. As shown in FIG. 25, the elastic ejector pin in the present embodiment is arranged on the holder 321 in such a manner that the holder 321 has a plurality of recesses on the surface facing the workpiece, such as the recess 3213, and plates with springs, such as the plate 326, which are embedded into the corresponding recesses, and a contact head is provided on the spring of the plate to form an elastic ejector pin. The elastic ejector pin allows the workpiece, such as the nut, to withstand the roller, so that the wrench does not have any idling and is more convenient in use.

The holder 321 in the present embodiment needs to be engaged with the baffle 324 to prevent the roller from falling off. Specifically, the end face of the holder 321 has a plurality of protrusions, such as the protrusion 3211, for mating with the notch (e.g., notch 3241) of the edge of the baffle 324 to realize positioning therebetween. The wrenching portion further includes a snap ring respectively abuts against the second member and the baffle, and its structure, function and arrangement are the same as those of the previous embodiment and will not be described here. The operation mode of the unidirectional transmission mechanism of the present embodiment is the same as that of the previous embodiment, and will not be described here.

Figure 26:
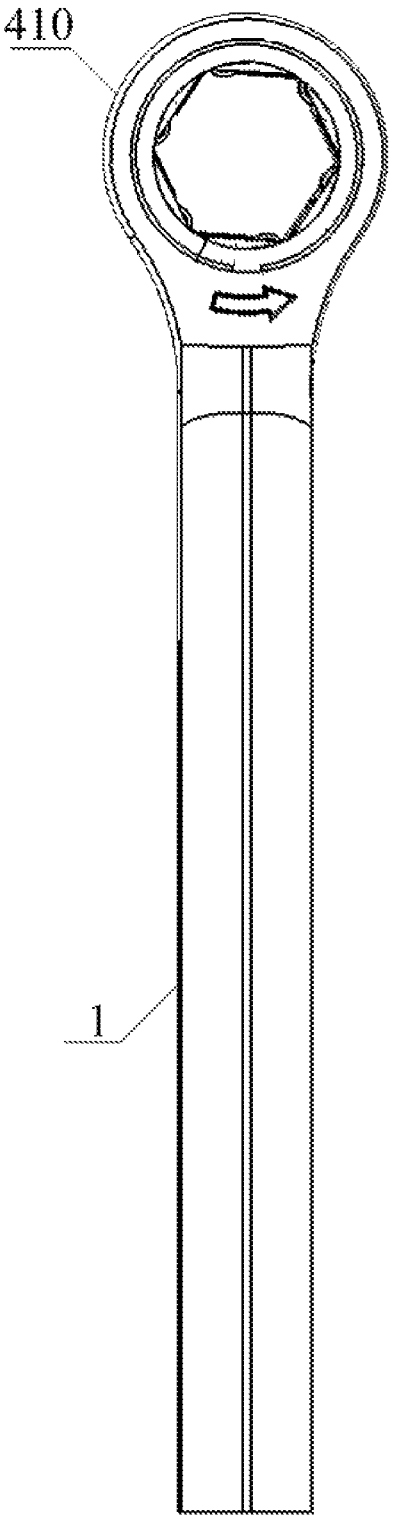
FIG. 26 is a front view of the wrench in a fifth embodiment of the present invention.
Figure 27:
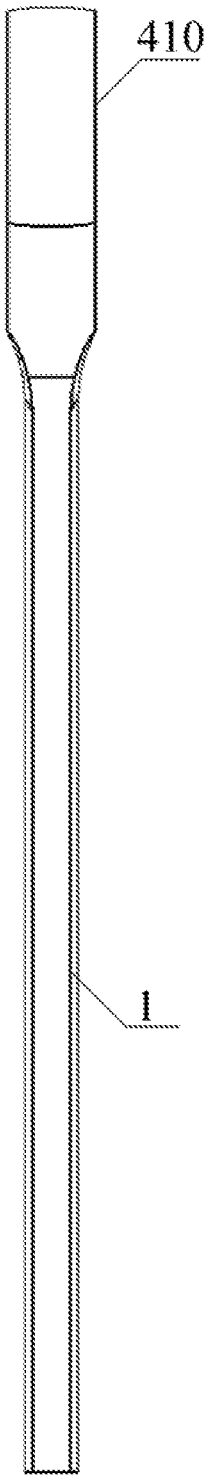
FIG. 27 is a side view of the wrench shown in FIG. 26.

As shown in FIGS. 26 and 27, in the fifth preferred embodiment, the wrench of the present invention has a wrenching portion, the gripping portion 1 extends and is connected with the wrenching portion at its extending end, and a unidirectional transmission mechanism is provided on the wrenching portion. The structure of the unidirectional transmission mechanism is as shown in FIGS. 28-33.

Figure 28:
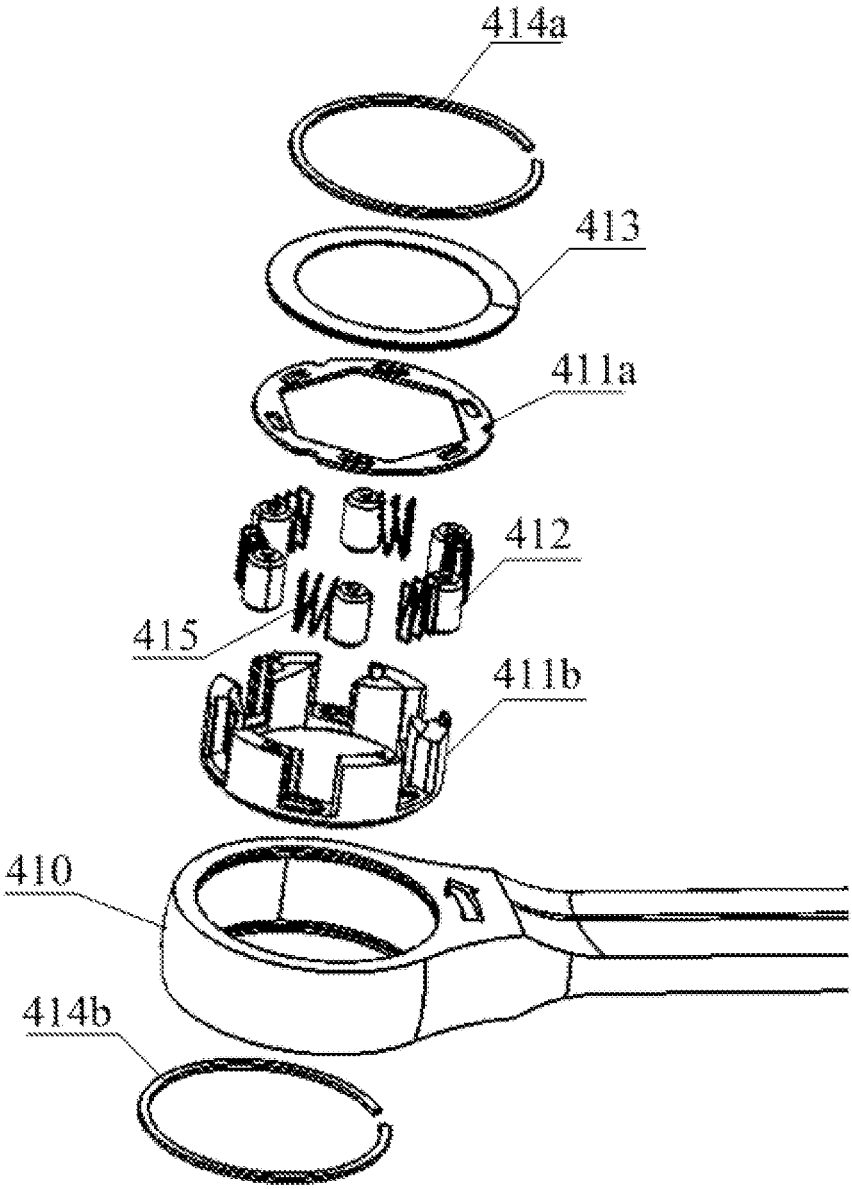
FIG. 28 is an exploded view of a structure of the wrenching portion of the wrench shown in FIG. 26.
Figure 29:
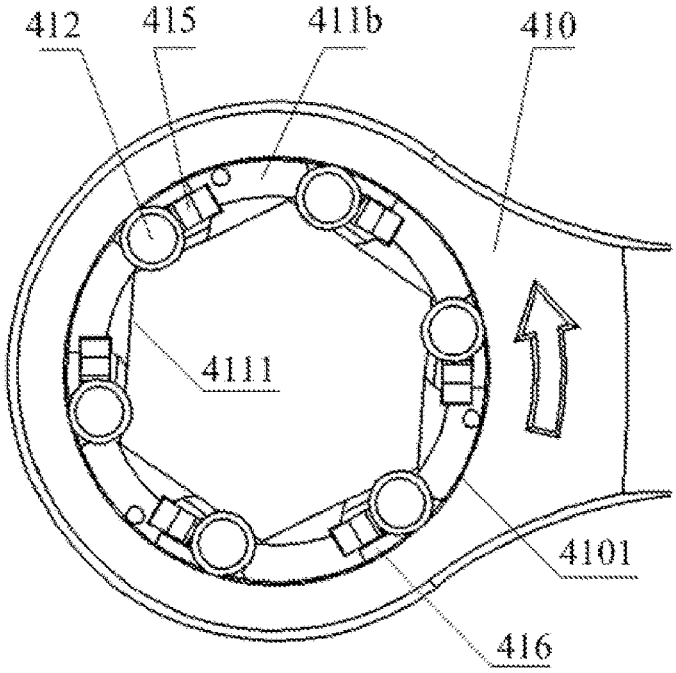
FIG. 29 shows a front view of the wrenching portion shown in FIG. 28.

The unidirectional transmission mechanism of the wrenching portion shown in FIGS. 28 and 29 includes a plurality of rollers such as the roller 412, a first member 410 and a second member, in which the second member includes a first part 411*a* and a second part 411*b* mating with each other to from a holder. The first member 410 is fixed to the wrenching portion, the second member is sheathed in the first member 410, and the axis of rotation of the second member is parallel to the axis of rotation of the first member 410, preferably the two coincide. Specifically, the gripping portion 1 is connected with the first member 410, and the user applies a rotating torque to the first member 410 by rotating the gripping portion 1. The direction of the rotating torque in the direction of its axis of rotation includes a first direction and a second direction, wherein the first direction is inwardly perpendicular to the paper as in FIG. 29, i.e., in the clockwise direction; the second direction is outwardly perpendicular to the paper as in FIG. 29, i.e., in the counterclockwise direction, as indicated by the arrow in the figure.

The first surface 4101 of the first member 410 facing the second member is a smooth curved surface, which in this example is a cylindrical surface; the holder of the second member is an annular body, on which a plurality of spaces spaced from each other are provided in a direction perpendicular to the axis of rotation of the first member 410 and the second member, and the respective rollers are accommodated in the respective spaces, respectively, and the space here is similar to the space 3212 on the second part as shown in FIG. 25. Each of the spaces has a first opening facing the first member 410 and a second opening facing the workpiece, whereby the space, which is confined by the first surface 4101 and the surface of the workpiece, becomes the movement room for the roller, such as the movement room 416. The movement room is designed to have a larger first part and a smaller second part. The roller contacts the first surface 4101 through the first opening of the space in which it is located and thereby can be driven by the first member 410, and the roller contacts the workpiece through the second opening. The first member 410 can drive the roller to move from the first part to the second part of the space in which it is located or from the second part to the first part by the friction between the two. The rollers in the first part can rotate freely and the rollers in the second part are sandwiched between the first member 410 and the workpiece.

Figure 30:
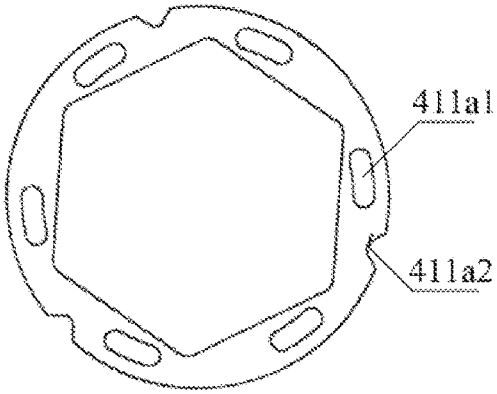
FIG. 30 shows a front view of the first part of the second member of the unidirectional transmission mechanism of the wrenching portion shown in FIG. 28.
Figure 31:
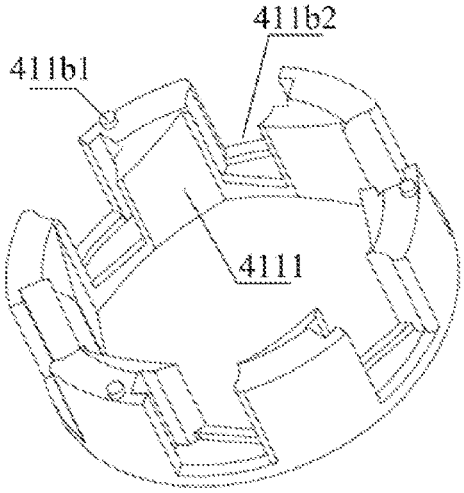
FIG. 31 shows a perspective view of the second part of the second member of the unidirectional transmission mechanism of the wrenching portion shown in FIG. 28.

The holder has a plurality of surface portions, such as the surface portion 4111, facing the workpiece, with the first part 411*a* and the second part 411*b* as shown in FIGS. 30 and 31, respectively. The first part 411*a* is a plate-like structure with an edge having a plurality of notches such as the notch 411*a*2; the second part 411*b* has a plurality of protrusions on the end face, such as the protrusion 411*b*1. The plurality of protrusions on the end face of the second part 411*b* mate with a plurality of notches at the edge of the first part 411*a*, respectively, to achieve positioning therebetween. The second part 411*b* has a plurality of recesses, such as recess 411*b*2. After the second part 411*b* is engaged with the first part 411*a*, the recess portions form the above-described space of the holder.

The second member has a limit structure so that the roller does not come out of the space of the holder. The roller in this embodiment is a cylindrical roller or a needle roller having a protrusion at one end thereof, and the top end of the roller has a protrusion 4121. The limit structure is a sliding slot on the first part 411*a* of the holder, such as the sliding slot 411*a*1 as shown in FIG. 30. The protrusions of the respective rollers are respectively embedded into the respective sliding slots, thereby restricting the range of motion thereof, that is, being restricted in the above-mentioned space.

Figure 33:
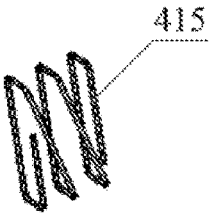
FIG. 33 shows a perspective view of the elastic member of the unidirectional transmission mechanism of the wrenching portion shown in FIG. 28.

Preferably, a laterally arranged elastic member is provided in the first part of the movement room in which each roller is located, such as the spring 415 shown in FIG. 33. Each of the elastic members respectively abuts against each of the respective rollers so that the respective rollers are sandwiched between the first member 410 and the workpiece. The spring extends in a direction from the first part to the second part of the movement room in which it is located, i.e., the direction of its restoring force is directed from the first part to the second part.

The wrenching portion in the present embodiment further includes a retaining ring 413 and snap springs 414*a*, 414*b*, and the retaining ring 413 abuts against a side of the second member, and the snap springs 414*a* and 414*b* respectively abut against the retaining ring 413 and a side of the second part 411*b* of the holder, and mate with the annular groove on the first surface 4101 of the first member 410, so as to define movement of the second member and the retaining ring 413 in the direction of its axis of rotation. The operation mode of the unidirectional transmission mechanism of the present embodiment is the same as that of the previous embodiment, and will not be described here.

Figure 34:
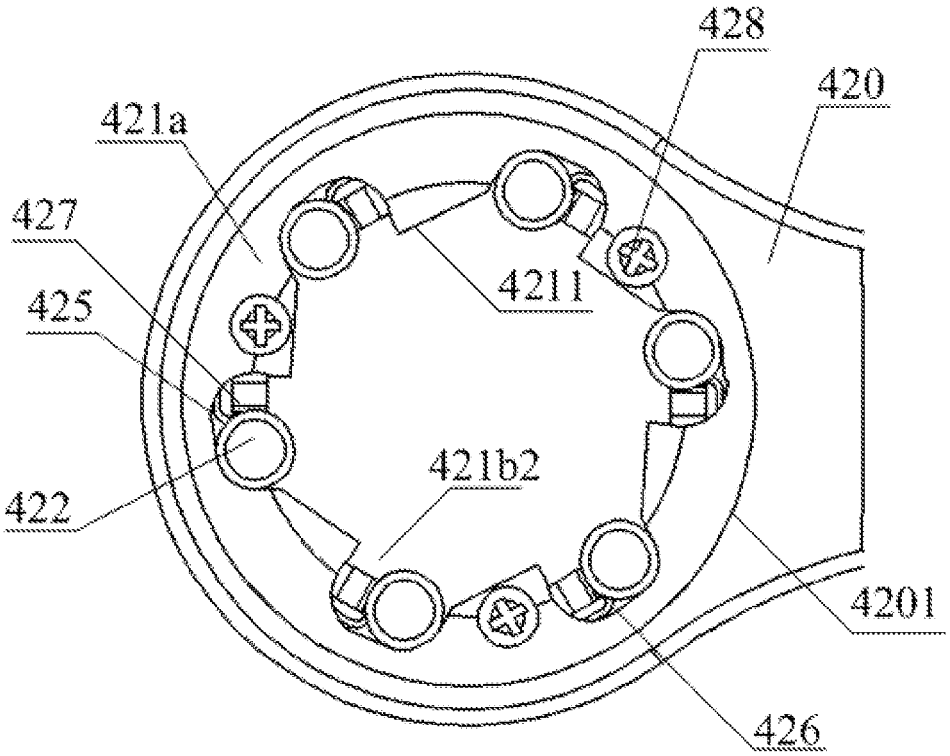
FIG. 34 is front view of another structure of the wrenching portion of the wrench shown in FIG. 28.
Figure 35:
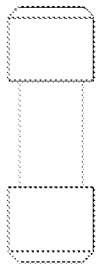
FIG. 35 shows a side view of the pin roller of the unidirectional transmission mechanism of the wrenching portion shown in FIG. 34.
Figure 36:
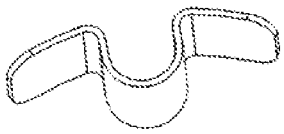
FIG. 36 shows a perspective view of the elastic member of the unidirectional transmission mechanism of the wrenching portion shown in FIG. 34.

FIGS. 34-36 show another structure of the second member and the roller of the wrenching portion in the present embodiment, the first surface 4201 of the first member 420 facing the second member is a smooth curved surface, which in this example is a cylindrical surface; the holder of the second member is an annular body on which a plurality of spaces spaced apart from each other are provided in a direction perpendicular to the axis of rotation of the first member 420 and the second member, and the respective rollers are respectively accommodated in the respective spaces, here the space is similar to the space 3212 on the second member shown in FIG. 25. Each of the spaces has a first opening facing the first member 420 and a second opening facing the workpiece, whereby the space confined by the first surface 4201 and the surface of the workpiece becomes the movement room for the roller, such as the movement room 426. The movement room is designed to have a larger first part and a smaller second part. The roller contacts the first surface 4201 through the first opening of the space in which it is located and thereby can be driven by the first member 420, and the roller contacts the workpiece through the second opening. The first member 420 can drive the roller to move from the first part to the second part of the space in which it is located or from the second part to the first part by the friction between the two. The rollers in the first part can rotate freely and the rollers in the second part are sandwiched between the first member 420 and the workpiece.

The first part 421*a* of the holder is a plate-like structure which is engaged with the second part by a plurality of screws such as the screw 428. The second part (the second part 411*b* as in the previous example) has a plurality of recesses, such as the recess 421*b*2. After the second part is engaged with the first part 421*a*, the recess portions form the above-described space of the holder. In addition, the holder has a plurality of surface portions, such as the surface portion 4211, facing the workpiece.

The second member has a limit structure so that the roller does not come out of the through hole and the recess. The roller in this embodiment is a cylindrical pin roller or needle roller with thinner middle portion, as shown in FIG. 35. The limit structure is an elastic sheet with a U-shaped middle portion, as shown in FIG. 36. By clipping the middle portion of the pin roller or needle roller into the U-shaped portion of the elastic sheet, the end of the elastic sheet is fixed on the holder, i.e., the range of movement of the roller is restricted, i.e., the roller is confined in the through hole and the recess. Moreover, the roller with such structure does not flip easily under the action of the elastic sheet.

In addition, the elastic sheet in the present structure can also function as the elastic member in the previous embodiment, such as the elastic sheet 425, and one side of the U-shaped portion thereof is urged by the ejector pin 427 to be fitted to the holder.

Each of the elastic sheets extends in a direction from a first part of the movement room in which it is located to a second part, i.e., the direction of its restoring force is directed from the first part to the second part.

In addition to the above-described parts, the structure, arrangement and operation of the first member 420, the second member and the roller in the present structure are the same as those of the previous structure and will not be described here.

The preferred specific embodiments of the invention have been described in detail above. It is to be understood that numerous modifications and variations can be made by those ordinary skilled in the art in accordance with the concepts of the present invention without any inventive effort. Hence, the technical solutions that may be derived by those skilled in the art according to the concepts of the present invention on the basis of the prior art through logical analysis, reasoning and limited experiments should be within the scope of protection defined by the claims.

The invention claimed is:

1. A wrench for wrenching a workpiece, comprising:

a wrenching portion and a gripping portion, the gripping portion extending and being connected at its extending end with the wrenching portion;

a unidirectional transmission mechanism comprising rollers, a first member and a holder at least partially sheathed in the first member; the first member is fixedly provided at the wrenching portion of the wrench, the holder is used for accommodating the rollers and receiving the workpiece;

wherein the directions of the rotating torque from the wrenching portion are a first direction and a second direction along an axis of rotation of the first member; for one of the rotating torque of the first direction and the rotating torque of the second direction, the roller causes the workpiece to be stationary relative to the first member so as to output the rotating torque to the workpiece; and for the other one of the rotating torque of the first direction and the rotating torque of the second direction, the roller causes the workpiece to rotate relative to the first member without outputting the rotating torque to the workpiece;

wherein a first surface of the first member facing the holder is a smooth curved surface, the holder is provided with a plurality of spaces spaced apart in a direction perpendicular to the axis of rotation, each of the rollers is respectively accommodated in each of the spaces; the space has a first opening facing the first surface and a second opening facing the workpiece, the roller comes into contact with the first surface through the first opening, thereby being able to be driven by the first member, the roller comes into contact with the workpiece through the second opening; the space defined by the first surface and the surface of the workpiece is a movement room for the roller therein, the roller driven by the first member is moving from a part to the first part, the roller in the first part can rotate freely and the roller in the second part is sandwiched between the first member and the workpiece; and wherein the roller is a pin roller or a needle roller, and at least one end of the pin roller or the needle roller has a protrusion; the holder is further provided with a limit structure, which does not allow the roller to detach from the space, and the limit structure is a sliding slot; and the protrusion is embedded into the sliding slot.

2. The wrench as claimed in claim 1, wherein the wrench further comprises an elastic member arranged in the first part, the elastic member extends in a direction from the first part to the second part and abuts the roller so that the roller is sandwiched between the first member and the workpiece.

3. The wrench as claimed in claim 1, wherein the roller is a ball roller, a pin roller or a needle roller, the width of the second opening is less than the diameter of the ball roller, the pin roller or the needle roller, so that the roller does not detach from the space.

4. The wrench as claimed in claim 1, wherein the holder is further provided with an elastic ejector pin for abutting the workpiece.

5. The wrench according to claim 1, wherein the roller is a pin roller or a needle roller, the diameter of a middle part of the pin roller or the needle roller is less than the diameters of an upper part and a lower part thereof; the holder is further provided with a limit structure which makes the roller do not detach from the space, and the limit structure is a partly U-shaped elastic sheet; the middle part of the pin roller or the needle roller is clipped into a U-shaped part of the elastic sheet, the upper part and the lower part of the pin roller or the needle roller are used for contacting with the first member and the workpiece.

6. The wrench as claimed in claim 1, wherein the wrench further comprises a retaining ring abutting an end face of the holder to confine the movement of the holder in the direction of the axis of rotation.

7. The wrench as claimed in claim 6, wherein the wrench further comprises a snap spring for abutting the retaining ring, the snap spring fits with an annular groove provided in the wrenching portion to prevent the retaining ring from detaching from the wrenching portion in the direction of the axis of rotation.

8. The wrench as claimed in claim 1, wherein the wrench is provided with two wrenching portions, the gripping portion is connected between the two wrenching portions.

* * * * *